US010737498B2

(12) United States Patent
Nukui et al.

(10) Patent No.: US 10,737,498 B2
(45) Date of Patent: Aug. 11, 2020

(54) LIQUID CARTRIDGE

(71) Applicant: BROTHER KOGYO KABUSHIKI KAISHA, Nagoya-shi, Aichi-ken (JP)

(72) Inventors: Kosuke Nukui, Nagoya (JP); Fumio Nakazawa, Okazaki (JP); Tetsuro Kobayashi, Nagoya (JP); Hiroaki Takahashi, Nagoya (JP); Akihito Ono, Nagoya (JP); Takahiro Miyao, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,912

(22) Filed: Mar. 29, 2018

(65) Prior Publication Data

US 2019/0100017 A1 Apr. 4, 2019

(30) Foreign Application Priority Data

Sep. 29, 2017 (JP) ..... 2017-189583

(51) Int. Cl.
*B41J 2/175* (2006.01)

(52) U.S. Cl.
CPC ..... *B41J 2/1753* (2013.01); *B41J 2/1752* (2013.01); *B41J 2/17513* (2013.01); *B41J 2/17523* (2013.01); *B41J 2/17526* (2013.01); *B41J 2/17543* (2013.01); *B41J 2/17546* (2013.01); *B41J 2/17553* (2013.01)

(58) Field of Classification Search
CPC . B41J 2/17526; B41J 2/17543; B41J 2/17553
See application file for complete search history.

(56) References Cited

U.S. PATENT DOCUMENTS

| | | | |
|---|---|---|---|
| 5,949,459 | A | 9/1999 | Gasvoda et al. |
| 2006/0164482 | A1 | 7/2006 | Katayama et al. |
| 2008/0049081 | A1 | 2/2008 | Hayashi et al. |
| 2012/0056955 | A1 | 3/2012 | Kodama et al. |
| 2013/0182052 | A1 | 7/2013 | Matsuzaki et al. |

(Continued)

FOREIGN PATENT DOCUMENTS

| | | | |
|---|---|---|---|
| EP | 2 803 488 | A2 | 11/2014 |
| JP | 2002-508720 | A | 3/2002 |

(Continued)

OTHER PUBLICATIONS

Office Action issued in related U.S. Appl. No. 15/939,671, dated Nov. 16, 2018.

(Continued)

*Primary Examiner* — Kristal Feggins
*Assistant Examiner* — Kendrick X Liu
(74) *Attorney, Agent, or Firm* — Merchant & Gould P.C.

(57) ABSTRACT

A liquid cartridge includes a chamber, a liquid outflow path, a circuit board, a first surface and a second surface. The chamber stores liquid. The liquid outflow path extends from the chamber to an outlet formed at the liquid outflow path. The outlet is to communicate with an exterior of the liquid cartridge and faces frontward. The circuit board is disposed rearward relative to the outlet. The first surface faces at least upwardly. The second surface faces at least rearwardly. The circuit board includes at least one of the first surface and the second surface.

18 Claims, 20 Drawing Sheets

(56) References Cited

U.S. PATENT DOCUMENTS

| | | | | |
|---|---|---|---|---|
| 2013/0258008 | A1* | 10/2013 | Kanbe | B41J 2/17526 347/86 |
| 2014/0055535 | A1* | 2/2014 | Takagi | B41J 2/1752 347/86 |
| 2014/0055536 | A1 | 2/2014 | Takagi et al. | |
| 2014/0168324 | A1 | 6/2014 | Sasaki | |
| 2014/0340453 | A1* | 11/2014 | Nagashima | B41J 2/17513 347/86 |
| 2016/0221350 | A1 | 8/2016 | Takagi et al. | |
| 2016/0279958 | A1 | 9/2016 | Wang et al. | |
| 2016/0279959 | A1 | 9/2016 | Okazaki et al. | |

FOREIGN PATENT DOCUMENTS

| | | | |
|---|---|---|---|
| JP | 2013-49164 | A | 3/2013 |
| JP | 2013-212588 | A | 10/2013 |
| WO | 2017/130243 | A1 | 8/2017 |

OTHER PUBLICATIONS

Office Action issued in related U.S. Appl. No. 15/939,460, dated Dec. 4, 2018.

Extended European Search Report issued in related European Patent Application No. 18165167.0, dated Sep. 21, 2018.

International Search Report and Written Opinion issued in related International Patent Application No. PCT/JP2018/013185, dated May 29, 2018.

* cited by examiner

LIQUID CARTRIDGE

CROSS-REFERENCE TO RELATED APPLICATION

This application claims priority from Japanese Patent Application No. 2017-189583 filed on Sep. 29, 2017, the content of which is incorporated herein by reference in its entirety.

FIELD OF DISCLOSURE

The disclosure relates to a liquid cartridge storing liquid, and a system including the liquid cartridge and a receiver to which the liquid cartridge is removably attached.

BACKGROUND

There has been known a system including an ink cartridge and an inkjet recording apparatus, for example, as disclosed in Japanese Patent Application Publication No. 2013-49164. The inkjet recording apparatus includes a receiver to which the ink cartridge is removably attached. The receiver includes a coil spring, a lock member, and an electrical contact. The ink cartridge includes an engagement portion and an IC board. The ink cartridge is inserted into the receiver against basing force of the coil spring acting in a direction in which the ink cartridge is removed. The engagement portion has an engagement surface configured to receive the basing force. The engagement surface of the ink cartridge engages with the lock member of the receiver, thereby holding the ink cartridge in a fully attached position in the receiver against the biasing force.

The IC board of the ink cartridge has memory mounted thereon. The memory stores information indicating, for example, ink color, ink materials, and an amount of ink stored in the ink cartridge. The IC board has an electrode formed thereon. The electrode is configured to electrically connect to the memory. When the ink cartridge is in the fully attached position, the electrode electrically connects to the contact of the receiver, thereby allowing the inkjet recording apparatus to read out the information stored in the memory. When the ink cartridge is in the fully attached position, the electrode and the contact need to be positioned accurately to establish reliable electrical contact therebetween.

SUMMARY

In the above-described system, the ink cartridge is held in the fully attached position in the receiver using the engagement portion, which is a separate member from the electrode of the IC board. In this configuration, the position of the engagement portion when the ink cartridge is in the fully position and the position of the electrode on the IC board may affect the positioning of the electrode of the ink cartridge relative to the contact of the receiver.

In view of the foregoing, one or more aspects of the disclosure provide a liquid cartridge that may position an electrode of the liquid cartridge with accuracy.

In accordance with the present disclosure, the liquid cartridge includes a chamber, a liquid outflow path, a circuit board, a first surface and a second surface. The chamber stores liquid. The liquid outflow path extends from the chamber to an outlet formed at the liquid outflow path. The outlet is to communicate with an exterior of the liquid cartridge and faces frontward. The circuit board is disposed rearward relative to the outlet. The first surface faces at least upwardly. The second surface faces at least rearwardly. The circuit board includes at least one of the first surface and the second surface.

DETAILED DESCRIPTION

Referring to the accompanying drawings, an illustrative embodiment of the disclosure will now be described. The illustrative embodiment described below is merely an example, and various changes, arrangements and modifications may be applied therein without departing from the spirit and scope of the disclosure.

[Overview of Printer 10]

Figure 1:
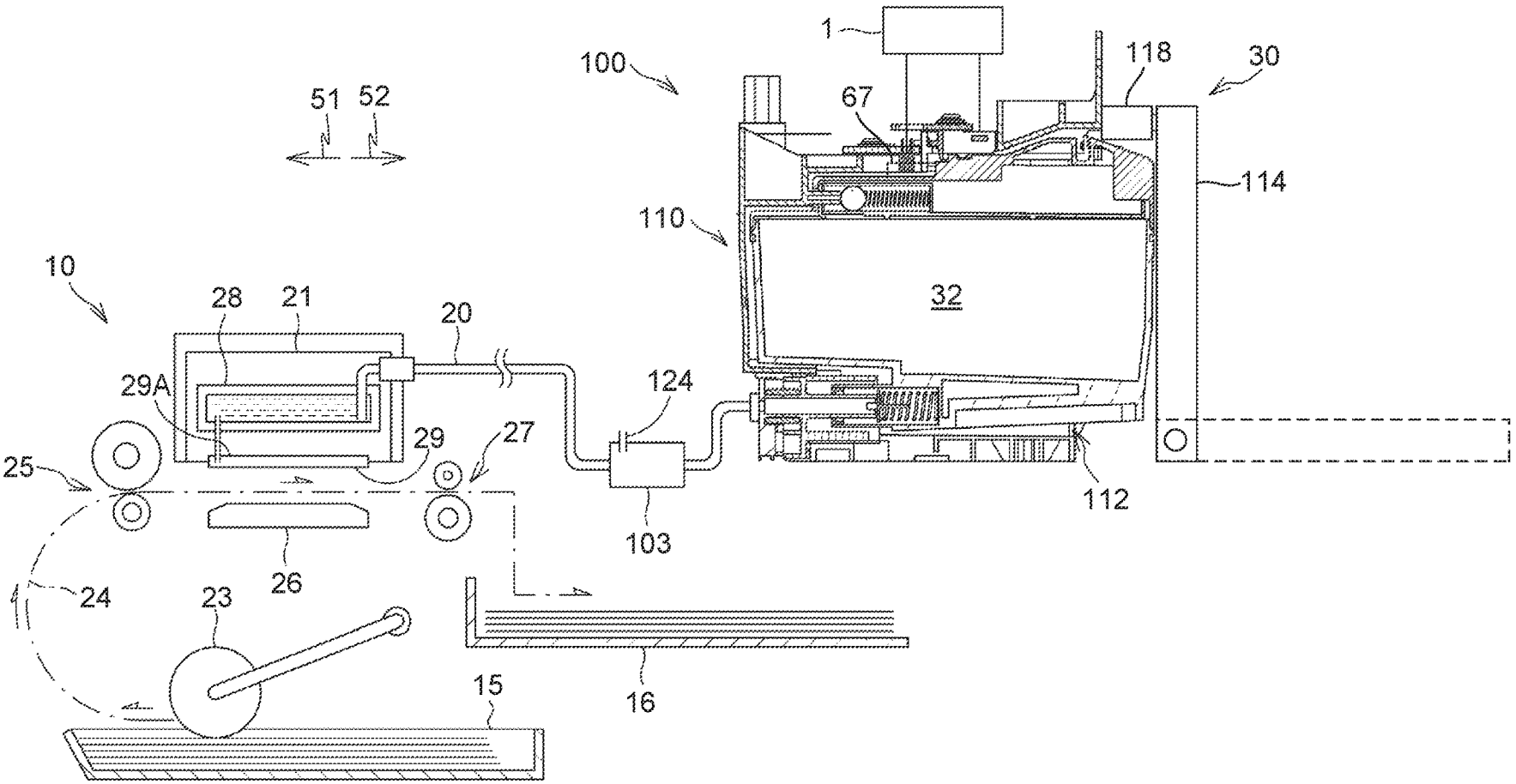
FIG. 1 is a vertical cross-sectional diagram conceptually illustrating an internal configuration of a printer including a cartridge-receiver configured to removably receive an ink cartridge in an illustrative embodiment according to one or more aspects of the disclosure.

As depicted in FIG. 1, a printer 10 is configured to record an image based on an inkjet recording method, by selectively ejecting ink droplets onto a sheet. The printer 10 includes a controller 1, a recording head 21, an ink-supplying device 100, and ink tubes 20 connecting the recording head 21 to the ink-supplying device 100. The ink-supplying device 100 includes a cartridge-receiver 110. The cartridge-receiver 110 is configured to receive ink cartridges 30 (an example of liquid cartridges). The cartridge-receiver 110 has a surface having an opening 112. The ink cartridges 30 can be inserted into and removed from the cartridge-receiver 110 through the opening 112.

Each ink cartridge 30 stores ink (an example of liquid) for use in the printer 10. As will be described in detail below, the ink cartridge 30 includes, as depicted in FIGS. 4-7, a casing 31, an ink supply portion 34, an IC board 64 (an example of a circuit board) including four electrodes 65, and a light blocking plate 67. Each ink cartridge 30 is connected to the recording head 21 through a respective one of the ink tubes 20 when the ink cartridge 30 has been fully attached to the cartridge-receiver 110. The recording head 21 includes sub-tanks 28 each configured to temporarily store ink supplied from a corresponding ink cartridge 30 through a corresponding ink tube 20. The recording head 21 includes nozzles 29 through which ink supplied from the sub-tanks 28 is selectively ejected, in accordance with the inkjet recording method. In one example, the recording head 21 includes a head control board (not depicted), and piezoelectric elements 29A. Each of the piezoelectric elements 29A corresponds to a respective one of the nozzles 29. The head control board selectively applies drive voltages to the piezoelectric elements 29A, to eject ink selectively from the nozzles 29. In this way, the recording head 21 consumes ink stored in the ink cartridges 30 that have been attached to the cartridge-receiver 110.

The printer 10 includes a sheet tray 15, a sheet feeding roller 23, a conveying path 24, a pair of conveying rollers 25, a platen 26, a pair of discharge rollers 27, and a discharge tray 16. A sheet is fed from the sheet tray 15 by the sheet feeding roller 23 to the conveying path 24, and then conveyed by the conveying rollers 25 over the platen 26. The recording head 21 ejects ink onto the sheet being conveyed over the platen 26, thereby recording an image on the sheet. The sheet that has passed the platen 26 is discharged by the discharge rollers 27 onto the discharge tray 16.

[Ink-Supply Device 100]

As depicted in FIG. 1, the ink-supplying device 100 is disposed in printer 10. The ink-supplying device 100 includes the cartridge-receiver 110 to which the ink cartridges 30 are attached. FIG. 1 illustrates the ink cartridge 30 that has been completely or fully attached to the cartridge-receiver 110. The ink cartridge 30 is fully attached to the cartridge-receiver 110 in a fully attached posture (e.g., a first posture).

In the disclosure, a direction in which the ink cartridge 30 is inserted into the cartridge-receiver 110 (e.g., an insertion direction) is defined as a frontward direction 51. In the illustrative embodiment, the insertion direction is perpendicular to a gravitational direction. A direction in which the ink cartridge 30 is removed from the cartridge-receiver 110 (e.g., a removal direction) is defined as a rearward direction 52. The rearward direction 52 is opposite to the frontward direction 51. In the illustrative embodiment, the frontward direction 51 and the rearward direction 52 are perpendicular to the gravitational direction and parallel to a horizontal direction perpendicular to the gravitational direction. A direction coincident with the gravitational direction is defined as a downward direction 53. A direction opposite to the downward direction 53 or the gravitational direction is defined as an upward direction 54. A direction perpendicular to the frontward direction 51 and the downward direction 53 is defined as a rightward direction 55 or a leftward direction 56. Further, the frontward direction 51 and the rearward direction 52 may be collectively referred to as a "front-rear direction". The upward direction 54 and the downward direction 53 may be collectively referred to as an "up-down direction". The rightward direction 55 and the leftward direction 56 may be collectively referred to as a "right-left direction".

[Cartridge-Receiver 110]

Figure 2:
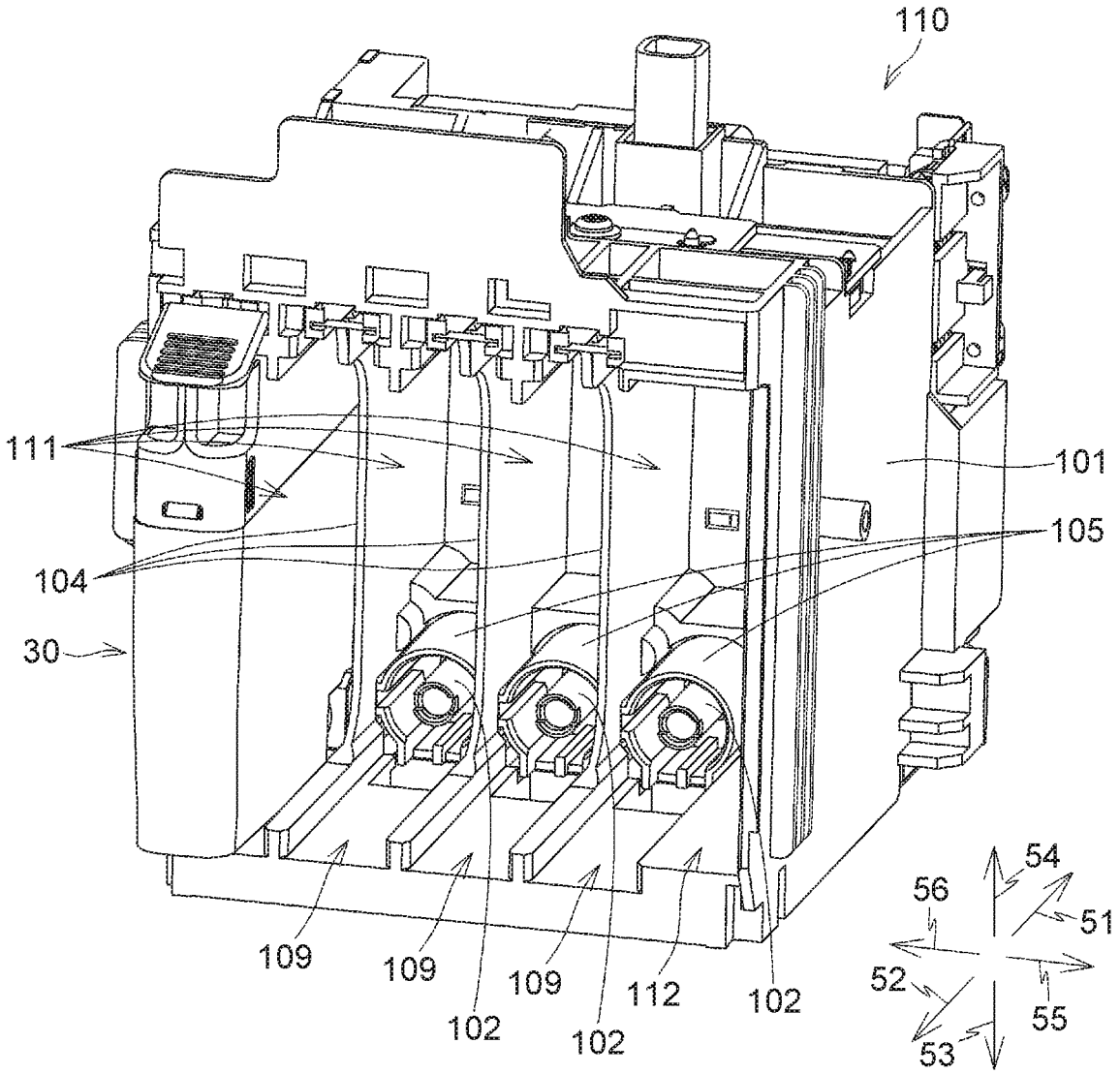
FIG. 2 is a perspective view of the cartridge-receiver.
Figure 3:
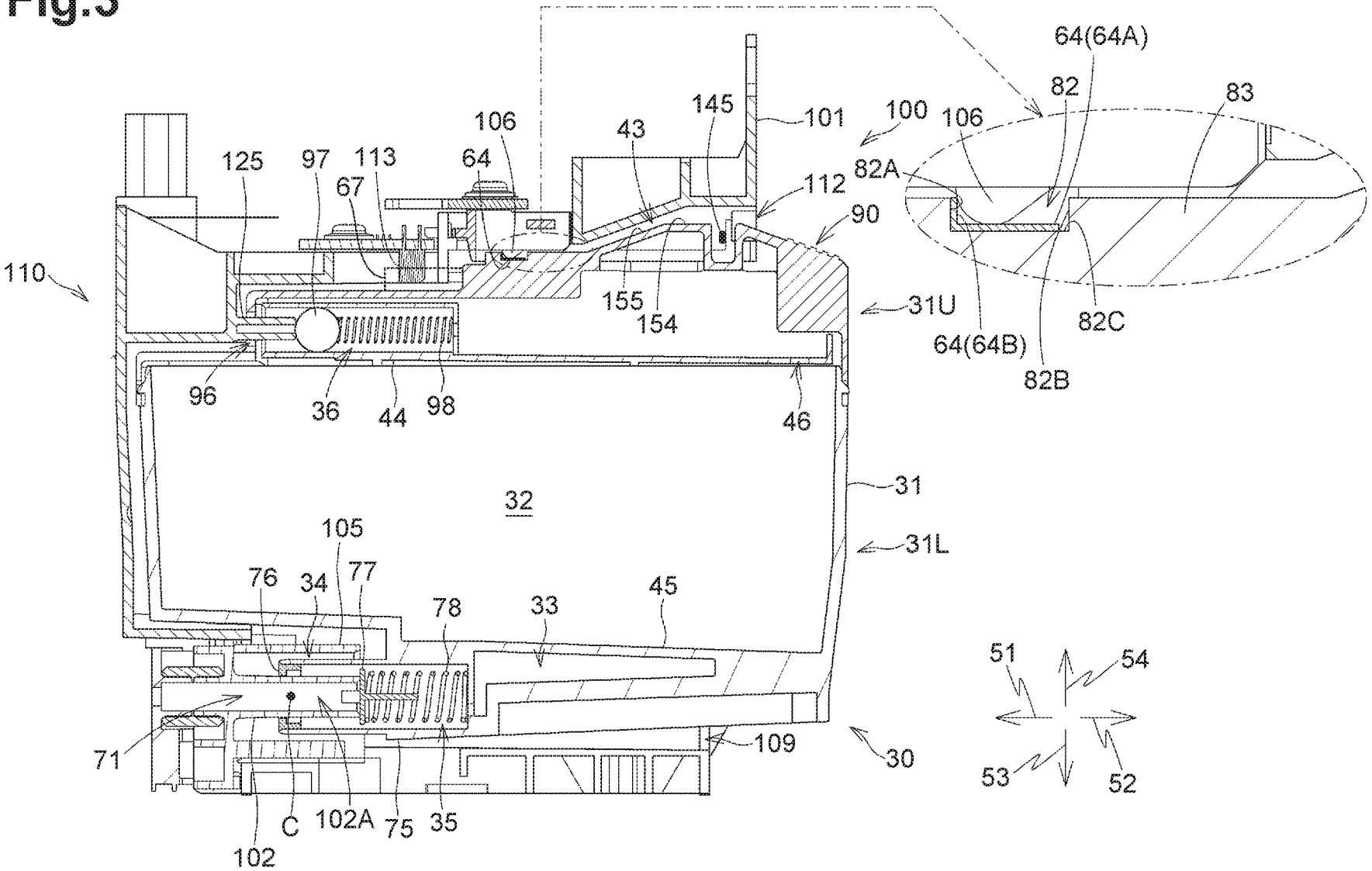
FIG. 3 is a vertical cross-sectional view of the ink cartridge attached to the cartridge-receiver in a first posture.

As depicted in FIG. 1 through FIG. 3, the cartridge-receiver 110 includes a cartridge holder 101, and four needles 102 (an example of liquid supply pipes), four tanks 103, four rods 125, four optical sensors 113, a shaft 145, four sets of electrical contacts 106, a cover 114 and a cover sensor 118. The cartridge-receiver 110 is configured to receive four ink cartridges 30, each containing different one of cyan, magenta, yellow, and black ink.

[Cartridge Holder 101]

As depicted in FIG. 2, the cartridge holder 101 has a box-like shape defining an interior space therein. The cartridge holder 101 includes a top wall, a bottom wall, an end wall, a right wall, and a left wall. The top wall defines the upper end of the interior space. The bottom wall defines the lower end of the interior space. The end wall defines the front end of the interior space and connects the top wall and the bottom wall. Each of the right wall and the left wall defines a respective one of right and left side ends of the interior space and connects the top wall and the bottom wall. The cartridge holder 101 has the opening 112 opposite to the end wall of the cartridge holder 101 in the front-rear direction.

The interior space is divided by three plates 104 into four individual spaces 111, each elongated in the up-down direction. The ink cartridge 30 can be inserted into and removed from the individual space 111 of the cartridge holder 101 through the opening 112. The cartridge holder 101 has guide grooves 109 formed at the bottom wall. During insertion, a lower end portion of the ink cartridge 30 is guided by a corresponding one of the guide grooves 109 along the front-rear direction. Each of the four ink needles 102, the four optical sensors 113, the four rods 125, and the four sets of the electrical contacts 106 is disposed in the interior space of the cartridge holder 101 in correspondence with a respective one of the individual spaces 111 configured to receive the ink cartridges 30.

[Cover 114]

The cover 114 is configured to open and close the opening 112 of the cartridge holder 101. The cover 114 is pivotally attached to the cartridge holder 101 about a shaft (not depicted) disposed near a lower end of the cartridge holder 101. The shaft extends in the right-left direction. The cover 114 is configured to pivotally move between a closed position, as depicted in FIG. 1, in which the opening 112 is closed, and an open position in which the opening 112 is open. When the cover 114 pivots from the closed position toward the open position, an upper end of the cover 114 pivotally moves rearward. When the cover 114 is in the open position, a user is allowed to attach or remove the ink cartridge 30 to or from the cartridge holder 101 through the opening 112. When the cover 114 is in the closed position, the user is not allowed to attach or remove the ink cartridge 30 to or from the cartridge holder 101.

[Needles 102]

As depicted in FIGS. 2 and 3, each of the needles 102 is formed of a resin into a hollow tubular shape. The needle 102 is disposed at a lower portion of the end wall of the cartridge holder 101, e.g., at a position corresponding to the ink supply portion 34 of the ink cartridge 30 when attached to the cartridge-receiver 110. The needle 102 protrudes in the removal direction relative to the end wall of the cartridge holder 101.

The needle 102 has a distal end, a base end, and an interior space 102A. Each of the distal end and the base end of the needle 102 has an opening. The distal end of the needle 102 is coupled directly or indirectly to the corresponding ink tube 20 (refer to FIG. 1). The interior space 102A of the needle 102 communicates with the recording head 21 and a corresponding one of the tanks 103, through the interior space of a corresponding ink tube 20.

As depicted in FIGS. 2 and 3, the needle 102 is surrounded by a cylindrical guide portion 105 that protrudes in the removal direction relative to the end wall of the cartridge holder 101. The needle 102 is located at a diametrical center of the guide portion 105.

The needle 102 may have a flat distal end, or a pointed or sharp distal end. The guide portion 105 may be formed into any shape, provided that the guide portion 105 can allow the insertion of the ink cartridge 30 in the insertion direction. The guide portion 105 may not necessarily be disposed at the cartridge-receiver 110.

[Electrical Contacts 106]

As depicted in FIG. 3, the four sets of electrical contacts 106 are disposed at the top wall of the cartridge holder 101. Each set has four electrical contacts 106 and is disposed at a respective one of the individual spaces 111 (refer to FIG. 2).

Each electrical contact 106 is located to the rear of the needle 102. The electrical contact 106 protrudes downward from the top wall of the cartridge holder 101 toward the interior space 111. The electrical contact 106 is formed of a plate-like material having electrical conductivity and elasticity, and can be upwardly elastically deformable. Although not illustrated in detail in the drawings, the four electrical contacts 106 in each individual space 111 are arranged in the right-left direction with a space therebetween.

Each electrical contact 106 is electrically connected to the controller 1 (refer to FIG. 1) of the printer 10. The controller 1 includes, for example, a CPU, a ROM, and a RAM. When the electrical contacts 106 contact the corresponding electrodes 65 and establish electrically connection with the electrodes 65, a voltage Vc may be applied to the electrodes 65; the electrodes 65 may be grounded; or power may be supplied to the electrodes 65. Establishment of electrical connection between the electrical contacts 106 and the corresponding electrodes 65 may allow the controller 1 to read data stored in memory of an IC of the ink cartridge 30 and to write data into the memory of the IC.

[Rods 125]

As depicted in FIG. 3, the rods 125 (one of which is shown in FIG. 3) are disposed at the end wall of the cartridge holder 101 above the needles 102. Each rod 125 protrudes rearward from the end wall of the cartridge holder 101. The rod 125 has a cylindrical shape. The interaction between the ink cartridge 30 and the rod 125 will be described below.

[Optical Sensors 113]

As depicted in FIG. 3, the optical sensors 113 (one of which is shown in FIG. 3) are disposed at the top wall of the cartridge holder 101 to the rear of the rods 125 but to the front of the electrical contacts 106. Each optical sensor 113 includes a light-emitting element and a light-receiving element. The light-emitting element and the light-receiving element are spaced from each other in the right-left direction. When the ink cartridge 30 is fully attached to the cartridge-receiver 110, the light blocking plate 67 (refer to FIG. 4) of the ink cartridge 30 is located between the light-emitting element and the light-receiving element. In other words, the light-emitting element and the light-receiving element oppose each other while sandwiching therebetween the light blocking plate 67 of the ink cartridge 30 that is in the fully attached posture.

The optical sensor 113 is configured to output, to the controller 1, signals based on whether the light emitted from the light-emitting element in the right-left direction is received by the light-receiving element. For example, the optical sensor 113 outputs a low level signal to the controller 1 when the light emitted from the light-emitting element is not received by the light-receiving element (e.g., when the intensity of the light received by the light-receiving element is less than a predetermined intensity). On the other hand, the optical sensor 113 outputs a high level signal to the controller 1 when the light emitted from the light-emitting element is received by the light-receiving element (e.g., when the intensity of the light received by the light-receiving element is equal to or greater than the predetermined intensity).

[Cover Sensor 118]

The cover sensor 118 is disposed at an upper portion of the cartridge holder 101. The cover sensor 118 is configured to detect whether the cover 114 contacts the cover sensor 118. When the cover 114 is in a closed position, an upper portion of the cover 114 contacts the cover sensor 118, so that the cover sensor 118 may output a first signal to the controller 1. When the cover 114 is not in the closed position or the open position, the cover 114 is in a position away from the sensor cover 118, so that the sensor cover 118 may output a second signal that is different from the first signal, to the controller 1.

[Shaft 145]

As depicted in FIG. 3, the shaft 145 is disposed at a portion of the cartridge holder 101 near its top wall and near the opening 112. The shaft 145 extends in the right-left direction of the cartridge holder 101 across the four individual spaces 111. The shaft 145 is located to the rear of the electrical contacts 106. For example, the shaft 145 is formed of metal into a cylindrical shape. Each left and right end of the shaft 145 is fixed to a respective one of the left and right walls of the cartridge holder 101, so that the shaft 145 may not move or rotate relative to the cartridge holder 101.

[Tanks 103]

As depicted in FIG. 1, the tanks 103 (one of which is depicted in FIG. 1) are disposed to the front of the cartridge holder 101. Each tank 103 has a box shape, and is configured to store ink therein. The tank 103 has a port 124 at an upper portion thereof. The port 124 may allow an interior space of the tank 103 to communication with the atmosphere. The interior space of the tank 103 communicates with the interior space 102A of the needle 102, so that ink flowing out of the ink cartridge 30 may be stored in the tank 103 via the needle 102. The ink stored in the interior space of the tank 103 is supplied to the recording head 21 through the ink tube 20 connected to the tank 103.

[Ink Cartridges 30]

Figure 4:
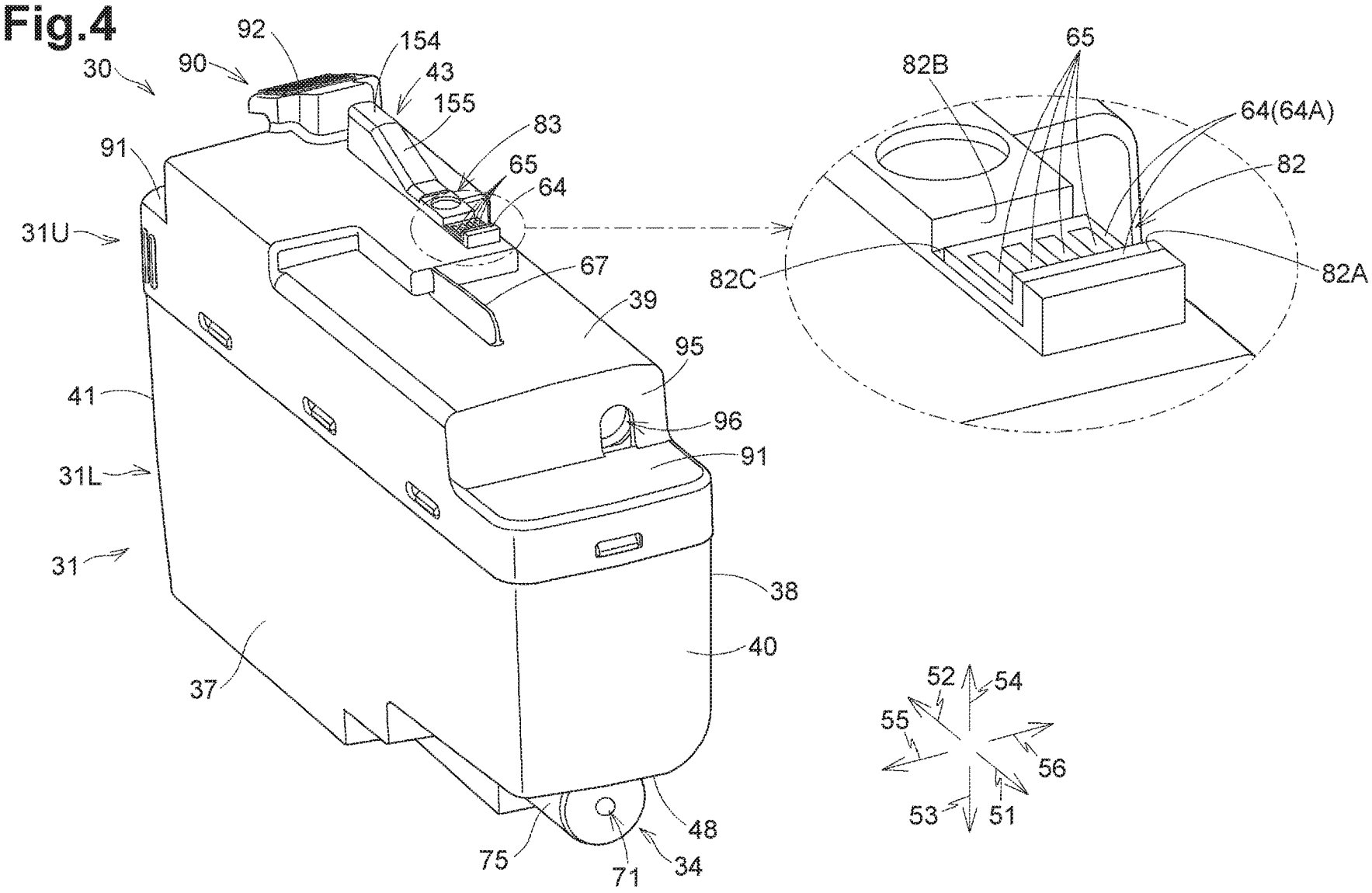
FIG. 4 is a perspective front view of the ink cartridge in an upright orientation.
Figure 5:
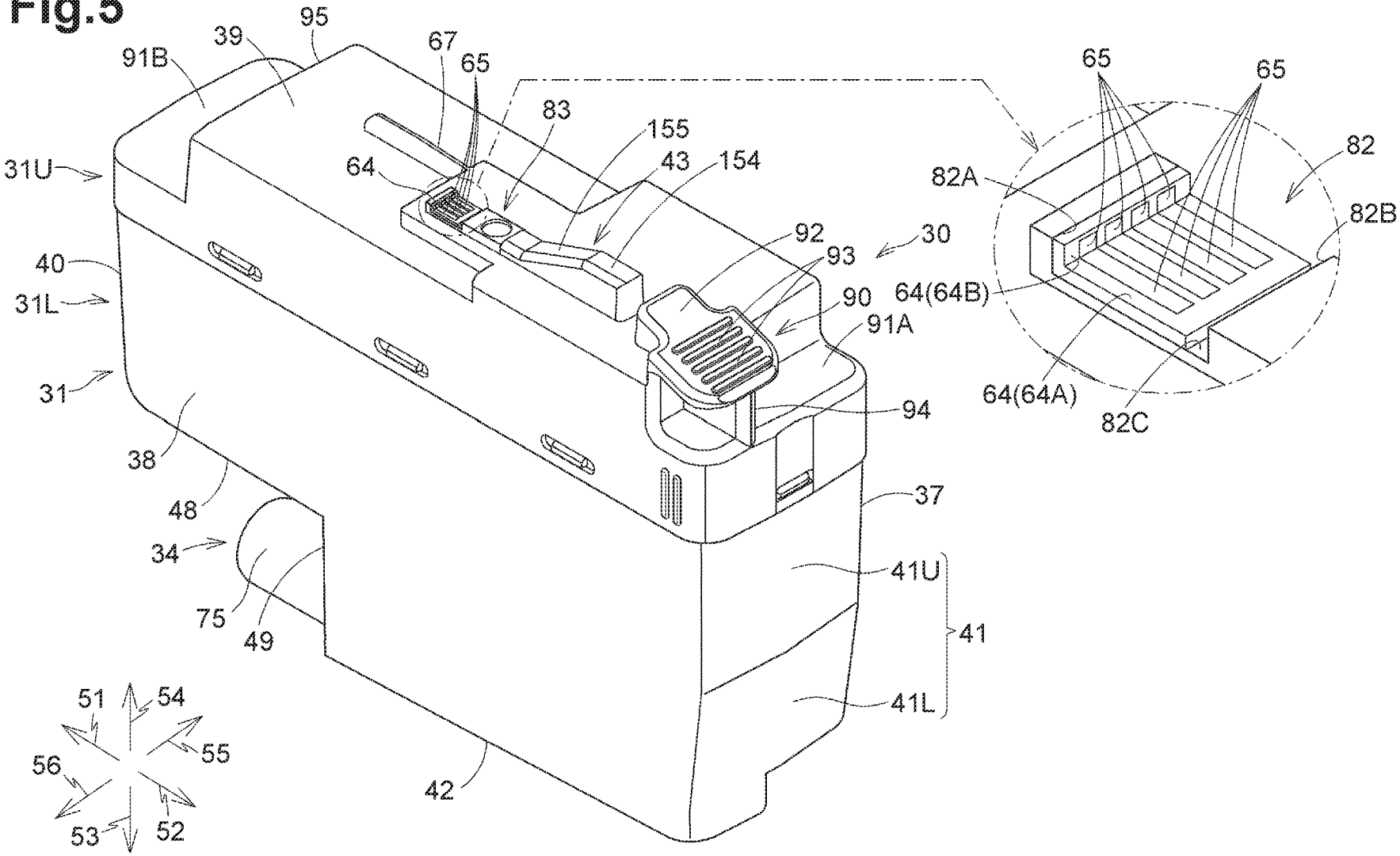
FIG. 5 is a perspective rear view of the ink cartridge in the upright orientation.
Figure 6A:
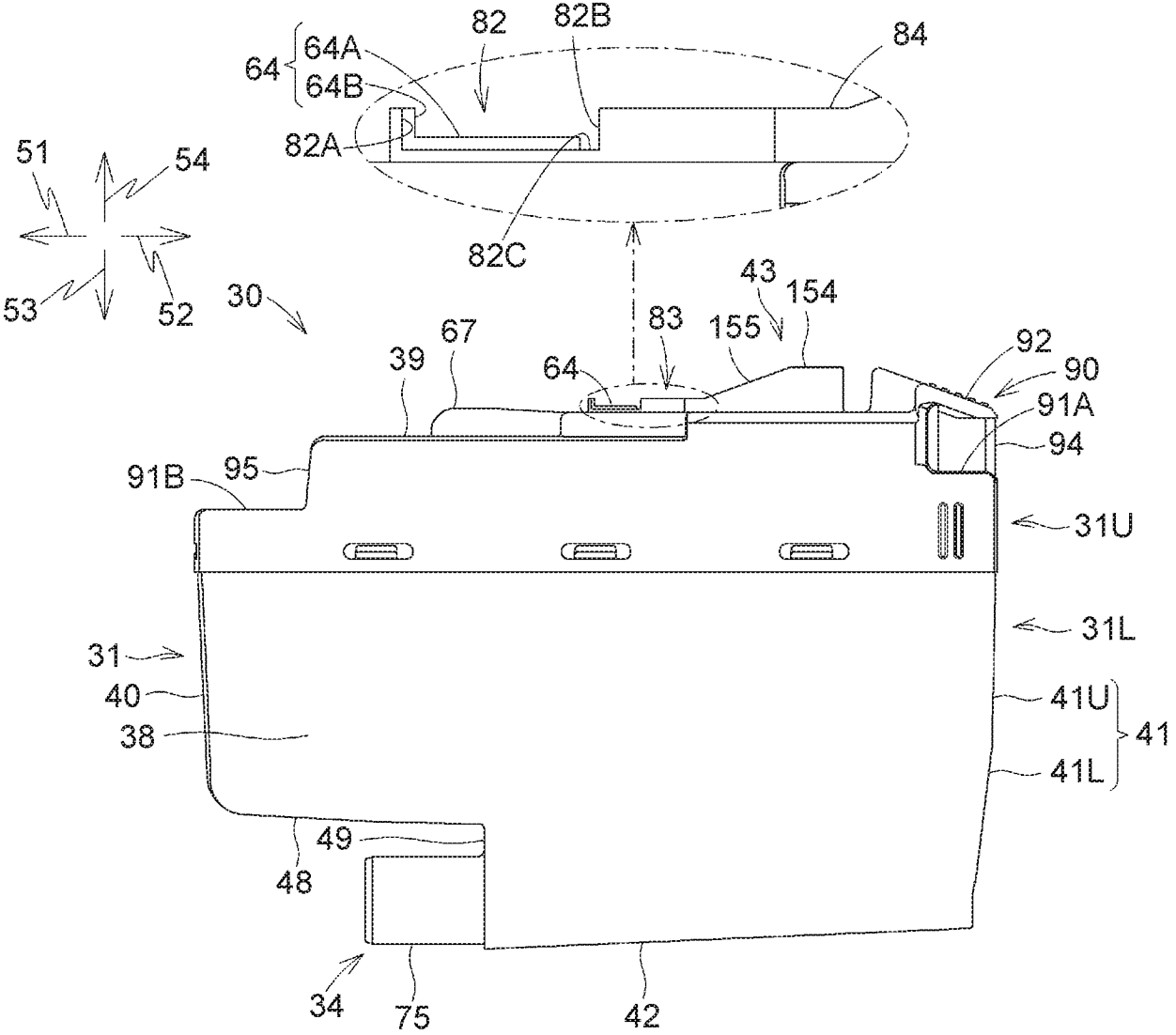
FIG. 6A is a left side view of the ink cartridge in the upright orientation.
Figure 6B:
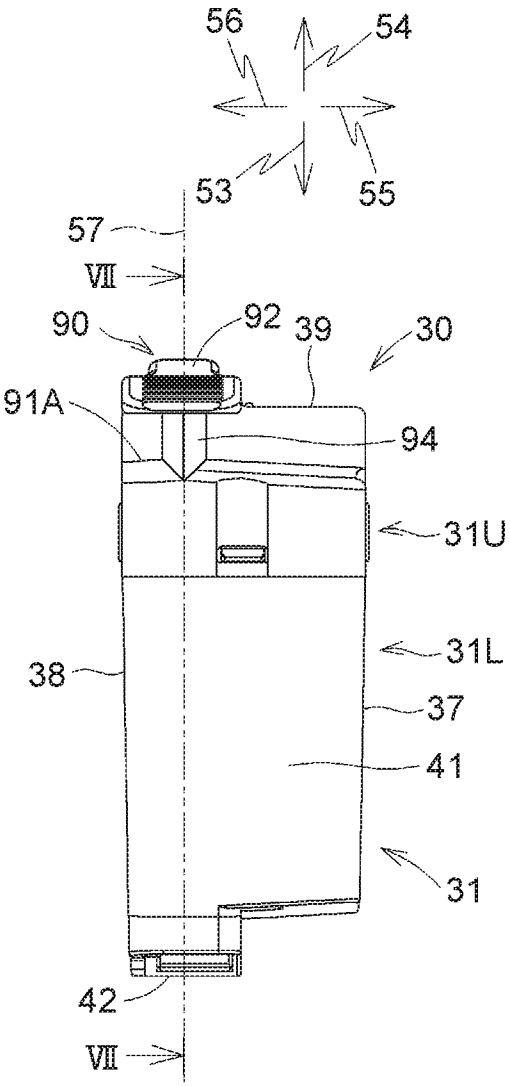
FIG. 6B is a rear view of the ink cartridge in the upright orientation.

As depicted in FIGS. 4-6, the ink cartridge 30 is a container storing ink therein. The ink cartridge 30 is shown in an upright orientation in FIGS. 4-6. The upright orientation is defined as an orientation of the ink cartridge 30 in which the ink cartridge 30 is insertable to the cartridge-receiver 110 in a direction perpendicular to the gravitational direction. The upright orientation corresponds to the first posture or the fully attached posture of the ink cartridge 30 as depicted in FIG. 1. In the following description, "top/upper", "bottom/lower", "front", "rear", "right", and "left" may be used to define the various parts or components of the ink cartridge 30, in conjunction with the upright orientation of the ink cartridge 30. When the ink cartridge 30 is in the upright orientation, the downward direction corresponds to the gravitational direction; the upward direction is opposite to the gravitational direction; the right-left direction corresponds to a width direction of the ink cartridge 30; the up-down direction corresponds to a height direction of the ink cartridge 30; and the front-rear direction corresponds to a depth direction of the ink cartridge 30. In the illustrative embodiment, the front-rear direction corresponds to the insertion direction or the removal direction in which the ink cartridge 30 is inserted into or removed from the cartridge-receiver 110.

The ink cartridge 30 includes the casing 31 having a substantially rectangular parallelepiped shape. In the illustrative embodiment, the casing 31 includes a lower case 31L and an upper cover 31U. The lower case 31L includes a first chamber 32 and a second chamber 33 (refer to FIG. 7), each storing ink therein. The upper cover 31U is located above the lower case 31L and engages with the lower case 31L. The upper cover 31U includes an air valve chamber 36.

The casing 31 has a generally flat box shape having a width in the right-left direction, a height in the up-down direction, and a depth in the front-rear direction, in which the width is less than each of the height and the depth.

The casing 31 includes a front wall 40, a rear wall 41, a top wall 39, a bottom wall 42, and side walls 37 and 38. Each of the front wall 40 and the rear wall 41 extends in the width direction and the height direction. Each of the top wall 39 and the bottom wall 42 extends in the width direction and the depth direction. Each of the side walls 37 and 38 extends in the depth direction and the height direction.

In the illustrative embodiment, a direction from the rear wall 41 toward the front wall 40 corresponds to the frontward direction 51; a direction from the front wall 40 toward the rear wall 41 corresponds to the rearward direction 52; a direction from the top wall 39 toward the bottom wall 42 corresponds to the downward direction 53; a direction from the bottom wall 42 toward the top wall 39 corresponds to the upward direction 54; a direction from the side wall 38 toward the side wall 37 corresponds to the rightward direction 55; and a direction from the side wall 37 toward the side wall 38 corresponds to the leftward direction 56.

Each of the front wall 40, the rear wall 41, the bottom wall 42, the top wall 39, the side walls 37 and 38 has a surface that partially defines outer surfaces of the casing 31. The outer surfaces of the casing 31 may be defined by a front surface of the front wall 40; a rear surface of the rear wall 41; a lower surface of the bottom wall 42; an upper surface of the top wall 39; a right surface of the side wall 37; and a left surface of the side wall 38. The front surface of the front wall 40 faces frontward; the rear surface of the rear wall 41 faces rearward; the lower surface of the bottom wall 42 faces downward; the upper surface of the top wall 39 faces upward; the right surface of the side wall 37 faces rightward; and the left surface of the side wall 38 faces leftward.

Figure 7:
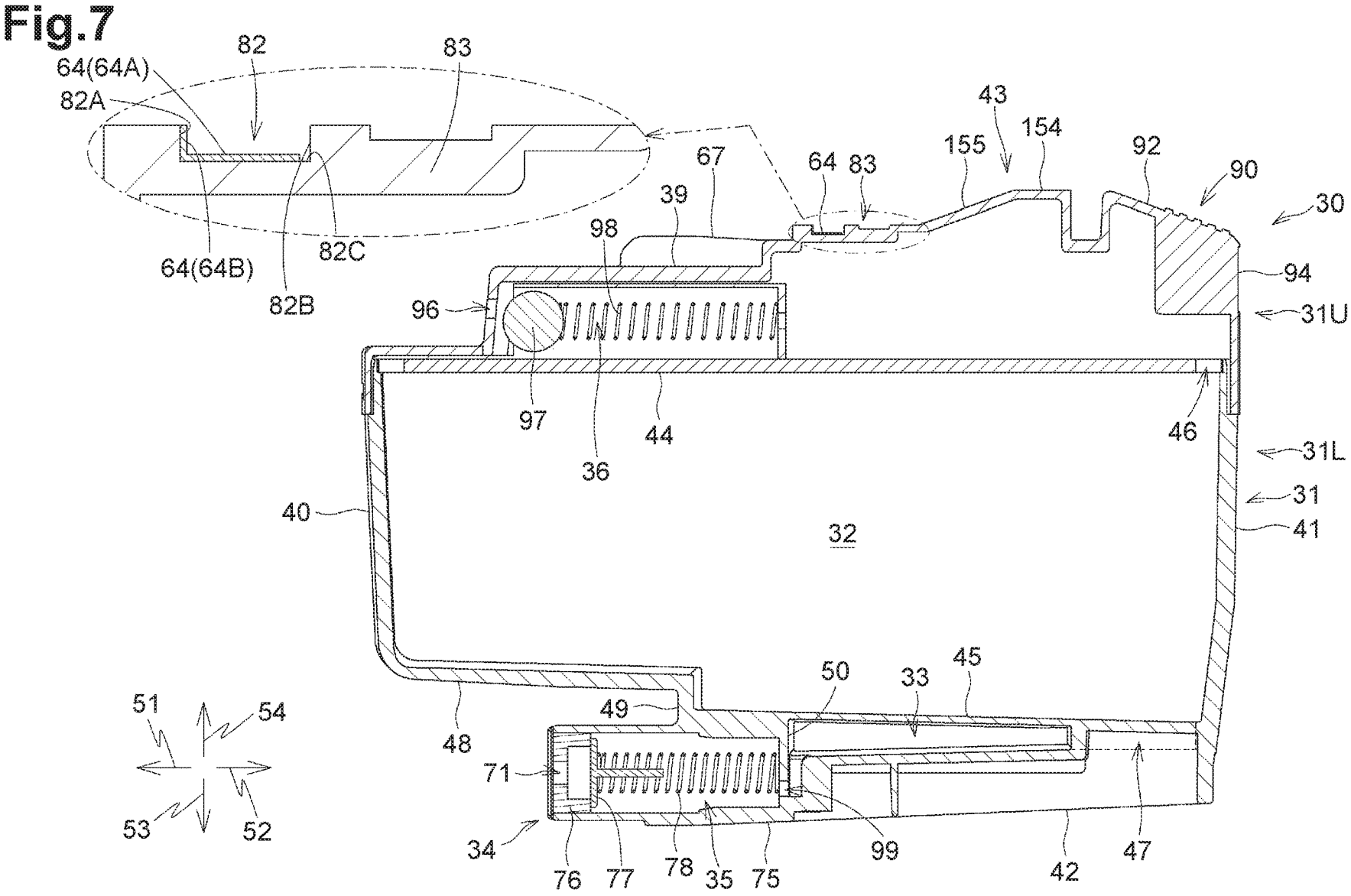
FIG. 7 is a cross-sectional view of the ink cartridge taken along the line VII-VII of FIG. 6B.

As depicted in FIG. 7, the front wall 40 is spaced from the rear wall 41 in the front-rear direction across the first chamber 32 and the air valve chamber 36. The top wall 39 is spaced from the bottom wall 42 in the up-down direction across the first chamber 32, the second chamber 33, and the air valve chamber 36. The side walls 37 and 38 are spaced from each other in the right-left direction with the first chamber 32, the second chamber 33, and the air valve chamber 36 interposed therebetween.

Each of the top wall 39 and the bottom wall 42 extends in the front-rear direction between the front wall 40 and the rear wall 41. Each of the side walls 37 and 38 extends in the front-rear direction between the front wall 40 and the rear wall 41, and in the up-down direction between the top wall 39 and the bottom wall 42.

Each of the front wall 40, the rear wall 41, the top wall 39, the bottom wall 42, and the side walls 37 and 38 defines a portion of at least one of the first chamber 32, the second chamber 33, and the air valve chamber 36.

At least a portion of the casing 31, e.g., the rear wall 41 of the lower case 31L, is translucent or transparent, so that a liquid surface of ink stored in the first chamber 32 and the second chamber 33 may be seen from the outside of the casing 31.

In the illustrative embodiment, the lower case 31L and the upper cover 31U constitute the casing 31. In another embodiment, a single member may constitute a casing 31. In yet another embodiment, telescoping inner and outer cases may constitute a casing 31. The inner case may define a chamber therein. The outer case may define an outer wall of the casing and may receive the inner case.

As depicted in FIGS. 5 and 6, the rear surface of the rear wall 41 includes an upper portion 41U and a lower portion 41L. The upper portion 41U is located above the lower portion 41L. The lower portion 41L is located closer to the front surface of the casing 31 than the upper portion 41U. Each of the upper portion 41U and the lower portion 41L is flat. The upper portion 41U and the lower portion 41L intersect with each other, forming an angle therebetween, which is not a right angle. The lower portion 41L is inclined relative to the up-down direction such that the lower portion 41L extends closer to the front wall 40 as it extends closer to the bottom wall 42.

The lower surface of the bottom wall 42 is angled relative to the front-rear direction such that a front end of the bottom wall 42 is located lower than its rear end. The lower surface of the bottom wall 42 may be angled at, for example, 2-4 degrees, relative to the horizontal direction. The rear end of the bottom wall 42 is connected to the lower end of the lower portion 41L of the rear wall 41.

The casing 31 further includes a lower sub-wall 48 and a front sub-wall 49. The lower sub-wall 48 is located above the bottom wall 42. The lower sub-wall 48 extends rearward continuously from the lower end of the front wall 40. The lower sub-wall 48 has a front end located to the front of a front end of the ink supply portion 34, and a rear end located to the rear of the front end of the ink supply portion 34. The front sub-wall 49 connects to the lower sub-wall 48 and the bottom wall 42. The ink supply portion 34 is located below the lower sub-wall 48 but above the bottom wall 42, and extends frontward through the front sub-wall 49. The front end of the lower sub-wall 48 may be located at any position, e.g., to the rear of the front end of the ink supply portion 34.

Each of the front wall, the rear wall, the top wall, the bottom wall, and the side walls of the ink cartridge 30 need not be configured as one wall. For example, in the illustrative embodiment, the front sub-wall 49 and a front sub-wall 95 (to be described below) constitute a front wall of the ink cartridge 30, together with the front wall 40, and the lower sub-wall 48 constitutes a lower wall of the ink cartridge 30, together with the bottom wall 42. Upper sub-walls 91A and 91B (to be described in detail below with reference to FIG. 6) constitute an upper wall of the ink cartridge 30, together with the top wall 39.

In the ink cartridge 30, the front surface of the front wall 40, the rear surface of the rear wall 41, the upper surface of the top wall 39, the lower surface of the bottom wall 42, the right surface of the side wall 37, and the left surface of the side wall 38, each need not be configured as one flat surface.

The front surface of the front wall 40 can be any surface (s) that can be seen when the ink cartridge 30 in the upright orientation is viewed from its front side, and is/are positioned to the front of a center of the ink cartridge 30 in the front-rear direction. In the illustrative embodiment, a front surface of the front sub-wall 49, which connects the bottom wall 42 and the lower sub-wall 48, and the front surface of the front wall 40, which connects the lower sub-wall 48 and the top wall 39, constitute a front surface of a front wall of the ink cartridge 30. The ink cartridge 30 may not necessarily include the lower sub-wall 48. In other words, the front surface of the front wall 40 of the ink cartridge 30 may be one continuous or flat surface that connects the top wall 39 and the bottom wall 42.

The rear surface of the rear wall 41 can be any surface(s) that can be seen when the ink cartridge 30 in the upright orientation is viewed from its rear side, and is/are positioned to the rear of the center of the ink cartridge 30 in the front-rear direction.

The top surface of the top wall 39 can be any surface(s) that can be seen when the ink cartridge 30 in the upright orientation is viewed from above, and is/are positioned above a center of the ink cartridge 30 in the up-down direction.

The bottom surface of the bottom wall 42 can be any surface(s) that can be seen when the ink cartridge 30 in the upright orientation is viewed from below, and is/are positioned below the center of the ink cartridge 3 in the up-down direction.

The right surface of the side wall 37 can be any surface(s) that can be seen when the ink cartridge 30 in the upright orientation is viewed from its right side, and is/are positioned to the right of a center of the ink cartridge 30 in the right-left direction.

The left surface of the side wall 38 can be any surface(s) that can be seen when the ink cartridge 30 in the upright orientation is viewed from its left side, and is/are positioned to the left of the center of the ink cartridge 30 in the right-left direction. [Protruding Portion 43 and Operation Portion 90]

As depicted in FIGS. 4-6, the ink cartridge 30 further includes a protruding portion 43 and an operation portion 90 that are disposed at the top wall 39 of the casing 31. The operation portion 90 is located behind the protruding portion 43.

The protruding portion 43 extends along the front-rear direction. The protruding portion 43 includes a horizontal surface 154 and a sloping surface 155. The horizontal surface 154 extends along the right-left direction and the front-rear direction. The sloping surface 155 is disposed in front of the horizontal surface 154 contiguous with the horizontal surface 154. The sloping surface 155 faces upward and frontward. The sloping surface 155 is angled at, for example, 15-25 degrees, relative to the horizontal direction. The sloping surface 155 is located to the rear of the IC board 64 (to be described in detail below).

The casing 31 includes a front upper sub-wall 91B and a rear upper sub-wall 91A. The front upper sub-wall 91B is disposed to the front of the top wall 39 and below a central portion of the top wall 39 in the front-rear direction. The rear upper sub-wall 91A is disposed to the rear of the top wall 39 and below the central portion of the top wall 39 in the front-rear direction. The rear upper sub-wall 91A is located below the operation portion 90 with a space therebetween. A portion of the operation portion 90 protrudes upward from the top wall 39 to substantially the same height as the protruding portion 43. Another portion of the operation portion 90 (which serves as an operation surface 92) extends rearward and downward, and is shaped like a flat plate. Disposed between the operation portion 90 and the rear upper sub-wall 91A is a rib 94 that is continuous with the operation portion 90 and the rear upper sub-wall 91A. The rib 94 extends rearward. The rib 94 has a dimension in the right-left direction smaller than a dimension of each of the operation portion 90 and the rear upper sub-wall 91A in the right-left direction.

The operation portion 90 includes the operation surface 92 facing upward and rearward. The operation surface 92 overlaps with the rear upper sub-wall 91A when the ink cartridge 30 is viewed from above. In other words, an imaginary plane extending in the up-down direction and the right-left direction includes the operation surface 92 and the rear upper sub-wall 91A.

The operation surface 92 includes a plurality of ridges 93 spaced from one another in the front-rear direction. The ridges 93 help a user to visually recognize the operation surface 92. The ridges 93 may provide the operation surface 92 to a non-slip gripping surface when the user operates or touches the operation surface 92 with his/her finger.

The operation surface 92 can be seen when the ink cartridge 30 is viewed from above and from the rear. The operation surface 92 may be operated by a user to remove, from the cartridge-receiver 110, the ink cartridge 30 in the first posture. The operation portion 90 is fixed to the casing 31, for example, by being integrally molded with the casing 31, so that operation portion 90 may not move or pivot relative to the casing 31. Accordingly, a force applied by the user to the operation surface 92 may be transmitted directly to the casing 31 without changing its direction.

[Protruding Portion 83]

As depicted in FIGS. 4-6, the ink cartridge 30 further includes a protruding portion 83 disposed at the upper surface of the top wall 39 of the casing 31 in front of the protruding portion 43. The protruding portion 83 extends along the front-rear direction. In the illustrative embodiment, the protruding portion 83 is contiguous with the protruding portion 43. In another embodiment, the protruding portion 83 may be spaced apart from the protruding portion 43 in the front-rear direction.

As depicted in FIGS. 4-6, the protruding portion 83 includes a recessed portion 82 recessed downward. The recessed portion 82 is defined by a front end surface 82A, a rear end surface 82B, and a bottom surface 82C. The front end surface 82A is perpendicular to the front-rear direction and faces rearward. The front end surface 82A defines a front end of the recessed portion 82. The rear end surface 82B is perpendicular to the front-rear direction and faces frontward. The rear end surface 82B defines a rear end of the recessed portion 82. The bottom surface 82C is perpendicular to the up-down direction and faces upward. The bottom surface 82C defines a bottom end of the recessed portion 82. A front end of the bottom surface 82C connects to a lower end of the front end surface 82A and a rear end of the bottom surface 82C connects to a lower end of the rear end surface 82B.

[Light Blocking Plate 67]

As depicted in FIGS. 4-6, the light blocking plate 67 is disposed at the upper surface of the top wall 39. The light blocking plate 67 protrudes upward and extends in the front-rear direction. The light blocking plate 67 is located to the front of the protruding portion 83. The light blocking plate 67 is located to the front of and below the IC board 64. In the illustrative embodiment, the light blocking plate 67 is a resin-made or plastic plate including, for example, light-absorbing coloring material (e.g., black pigment). In another embodiment, the light blocking plate 67 may be configured by attaching a material that does not transmit light, such as aluminum foil, to a side surface of a plate that can transmit light The light blocking plate 67 of the ink cartridge 30 in the first posture is configured to block the light output from the optical sensor 113 (e.g., from the light-emitting element toward the light-receiving element) and traveling in the right-left direction. For example, when the light emitted from the light-emitting element of the optical sensor 113 is incident on the light blocking plate 67 before arriving at the light-receiving element, the intensity of the light received at the light-receiving element is less than a predetermined intensity, and may be, for example, zero (0). The light blocking plate 67 may block or attenuate the light emitted from the light-emitting element toward the light-receiving element. The light blocking plate 67 may alter a traveling direction of light.

[Air Communication Opening 96]

As depicted in FIG. 4, the front sub-wall 95 has an air communication port 96 formed therein. The front sub-wall 95 extends upward from a rear end of the front upper sub-wall 91B, and includes a surface facing frontward. The air communication port 96 is located above the center of the casing 31 in the up-down direction. The air communication port 96 has a generally circular shape. The air communication port 96 has an inside diameter that is greater than an outside diameter of the rod 125 (refer to FIG. 3) of the cartridge-receiver 110.

[IC Board 64]

As depicted in FIGS. 4-6, the ink cartridge 30 includes the IC board 64 (an example of a circuit board). The IC board 64 is disposed closer to the top wall 39 than the bottom wall 42 of the ink cartridge 30 in the upright orientation. In the illustrative embodiment, the IC board 64 is located in the recessed portion 82 of the protruding portion 83. As depicted in FIG. 7, the IC board 64 is located to the rear of an ink supply port 71 (described below), an ink valve chamber 35 (described below), and the light blocking plate 67. In other words, the IC board 64 is located closer to the rear wall 41 in the front-rear direction, than the ink supply port 71, the ink valve chamber 35, and the light blocking plate 67.

The IC board 64 includes a flexible substrate, an IC, and a plurality of electrodes 65. In one example, the IC board 64 includes a flexible substrate of an insulating material, such as a thin plastic film, on which the IC and the electrodes 65 are mounted. The IC is connected to the electrodes 65.

The IC board 64 is positioned in the recessed portion 82 on the front end surface 82A and the bottom surface 82C of the recessed portion 82. The IC board 64 is attached, for example, by photo-curable resin, to the front end surface 82A and the bottom surface 82C while bending at a boundary between the front end surface 82A and the bottom surface 82C. In another embodiment, the IC board 64 may be attached by an adhesive other than photo-curable resin, or by other methods, such as by using fastening members.

The IC board 64 attached to the front end surface 82A and the bottom surface 82C includes a first surface 64A and a second surface 64B that are defined by an outer surface of the substrate of the IC board 64 and outer surfaces of the electrodes 65. The first surface 64A faces a direction opposite a direction that a surface of the IC board 64 attached to the bottom surface 82C faces. The first surface 64A is parallel to the bottom surface 82C and faces upward. The second surface 64B faces a direction opposite a direction that a surface of the IC board 64 attached to the front end surface 82A faces. The second surface 64B is parallel to the front end surface 82A and faces rearward. The first surface 64A is continuous with the second surface 64B and located to the rear of the second surface 64B.

Each of the electrodes 65 is electrically connected to the IC. Each of the electrodes 65 is exposed to an exterior of the ink cartridge 30 on the first surface 64A and the second surface 64B. The electrodes 65 are spaced apart from each other in the right-left direction. The electrodes 65 extend over the first surface 64A and the second surface 64B. A portion of each electrode 65 located in the first surface 64A extends along the front-rear direction, while another portion of the electrode 65 located in the second surface 64B extends along the up-down direction.

As depicted in FIG. 3, when the ink cartridge 30 is in the first posture in the cartridge-receiver 110, the electrodes 65 of the IC board 64 are electrically connected to the corresponding electrical contacts 106. In one example, a portion of each electrode 65 formed in the first surface 64A contacts a corresponding electrical contact 106 from below, and another portion of the electrode 65 formed in the first surface 64B contacts the electrical contact 106 from the front.

[Internal Configuration of Casing 31]

As depicted in FIG. 7, the casing 31 has the first chamber 32, the second chamber 33, the ink valve chamber 35, and the air valve chamber 36 that are formed therein. The first chamber 32, the second chamber 33, and the air valve chamber 36 are, each, an example of an liquid chamber. The ink valve chamber 35 is an example of a liquid outflow path. The first chamber 32, the second chamber 33, the ink valve chamber 35, and the air valve chamber 36 can hold ink therein. The first chamber 32 and the air valve chamber 36 are partitioned by a partition wall 44. The first chamber 32 and the second chamber 33 are partitioned by a lower wall 45. Each of the partition wall 44 and the lower wall 45 extends in the front-rear direction and the right-left direction. The partition wall 44 and the lower wall 45 oppose to each other in the up-down direction.

The first chamber 32 is enclosed by a lower surface of the partition wall 44, an upper surface of the lower wall 45, an inner surface (e.g., a rear surface) of the front wall 40, an inner surface (e.g., a front surface) of the rear wall 41, and an inner surface (e.g., a left surface) of the side wall 37 and an inner surface (e.g., a right surface) of the side wall 38. The lower surface of the partition wall 44 and the upper surface of the lower wall 45 define upper and lower edges of the first chamber 32, respectively. The inner surfaces of the front wall 40, the rear wall 41, and the side walls 37 and 38 define front, rear, and side edges of the first chamber 32, respectively. The partition wall 44 has a through-hole 46 formed therein. The first chamber 32 and the air valve chamber 36 communicate with each other via the through-hole 46.

The second chamber 33 is located below the first chamber 32. The second chamber 33 has a smaller volumetric capacity than the first chamber 32.

The second ink chamber 33 and the ink valve chamber 35 are partitioned by a partitioning wall 50. The second chamber 33 is enclosed by a lower surface of the lower wall 45, an upper surface of the bottom wall 42, a rear surface of the partition wall 50, the inner surface of the rear wall 41, the inner surface of the side wall 37, and the inner surface of the side wall 38. The lower surface of the lower wall 45 and the upper surface of the bottom wall 42 define upper and lower edges of the second chamber 33, respectively. The rear surface of the partition wall 50, the inner surface of the rear wall 41, and the inner surfaces of the side walls 37 and 38 define front, rear, and side edges of the second chamber 33, respectively. The second chamber 33 communicates with the first chamber 32, via a communication port (not depicted) formed in the lower wall 45. The partition wall 50 has a through-hole 99 formed therein. The second chamber 33 communicates with the ink valve chamber 35 via the through-hole 99.

Within the air valve chamber 36, a valve 97 and a coil spring 98 are disposed. The air valve chamber 36 can communicate with an exterior of the ink cartridge 30, via the air communication port 96 formed in the front sub-wall 95. The valve 97 is configured to move between a closed position and an open position. At the closed position, the value 97 closes the air communication port 96. At the open position, the value 97 is located away from the air communication port 96. The coil spring 98 is expandable and contractible in the front-rear direction, and is configured to bias the valve 97 frontward toward the air communication port 96. A member for sealing the air communication port 96 is not limited to the valve 97, but may include, for example, a removable label. The label may be removably affixed to the front sub-wall 95 to seal the air communication port 96.

The ink supply portion 34 is disposed at the front sub-wall 49. The ink supply portion 34 has a cylindrical outer shape. The ink supply portion 34 includes a tubular portion 75 having an open front end, and a packing 76 (an example of a sealing member) having the ink supply port 71. The tubular portion 75 protrudes frontward relative to the front sub-wall 49. The tubular portion 75 defines an interior space therein that serves as the ink valve chamber 35. The ink valve chamber 35 is a space extending along the front-rear direction when the ink cartridge 30 is in the upright orientation. The ink valve chamber 35 communicates with the second chamber 33, via the through-hole 99 located behind the ink valve chamber 35. The front end of the tubular portion 75 is open to an exterior of the ink cartridge 30. In other words, the ink valve chamber 35 brings the second chamber 33 into communication with the exterior of the ink cartridge 30. The ink valve chamber 35 extends frontward, allowing ink in the second chamber 33 to flow in the frontward direction 51 toward the exterior of the ink cartridge 30. The packing 76 is disposed at a front end portion of the tubular portion 75 or the ink valve chamber 35. The packing 76 will be described in more detail below.

Within the ink valve chamber 35, a valve 77 and a coil spring 78 are disposed. The valve 77 is configured to move along the front-rear direction to open and close the ink supply port 71 (an example of an outlet) formed through a central portion of the packing 76. The coil spring 78 is configured to bias the valve 77 frontward. The valve 77 closes the ink supply port 71 of the packing 76 when external forces are not applied to the valve 77.

The packing 76 is a disk-shaped member having a through-hole formed at a central portion thereof. The packing 76 is formed of elastic material, such as rubber or elastomer. The through-hole extending through the central portion of the packing 76 in the front-rear direction has a tubular-shaped inner peripheral surface that defines the ink supply port 71. In other words, the packing 76 is disposed around a peripheral edge of the ink supply port 71. The ink supply port 71 has an inside diameter, that is slightly smaller than an outside diameter of the needle 102. The ink supply port 71 allows the interior space of the tubular portion 75 (the ink valve chamber 35) to communicate with the exterior of the ink cartridge 30 therethrough. In other words, the ink valve chamber 35 brings the second chamber 33 into communication with the exterior of the ink cartridge 30, through the ink supply port 71 that opens to the front.

The ink supply port 71 may be closed by a film, instead of the valve 77. In this configuration, the ink supply port 71 may be provided at a front end of the tubular portion 75, not at the packing 76. Alternatively, the ink supply port 71 may be formed by piercing the needle 102 into a sealing member which is made of an elastic resin, and may be closed by an elasticity of the sealing member as the needle 102 is removed from the sealing member. The ink supply portion 34 need not be provided as a cylindrical member. For example, the front wall 40 of the casing 31 may have a through-hole extending therethrough in the front-rear direction. The front wall 40 having the through-hole may partially define an ink supply portion 34.

[Attachment and Removal of Ink Cartridge 30 to/from Cartridge-Receiver 110]

Attachment of the ink cartridge 30 to the cartridge-receiver 110 will now be described.

In the ink cartridge 30 prior to attachment to the cartridge-receiver 110, the valve 77 closes the ink supply port 71 of the packing 76, as depicted in FIG. 7, preventing flow of ink to the exterior of the ink cartridge 30 through the ink valve chamber 35. Further, the valve 97 closes the air communication port 96, preventing the first chamber 32 from communicating with the atmosphere.

The ink cartridge 30 is inserted in the upright orientation into the cartridge holder 101 through the opening 112 (refer to FIG. 2) of the cartridge-receiver 110. The upper portion 41U of the rear wall 41 of the casing 31 is located to the rear of the lower portion 41L. In other words, the upper portion 41U is located closer to a user than the lower portion 41L. The user may push the upper portion 41U frontward to insert the ink cartridge 30 into the cartridge holder 101 of the cartridge-receiver 110. A lower portion of the ink cartridge 30 may enter the guide groove 109 (refer to FIG. 2) located at a lower portion of the cartridge holder 101.

As the ink cartridge 30 is being inserted into the cartridge holder 101, the ink supply portion 34 moves relative to the cartridge holder 101 into a space defined by the cylindrical guide portion 105 in the individual space 111. When the ink supply portion 34 is located in the space defined by the guide portion 105, the rod 125 is located in the air communication port 96, and the light blocking plate 67 (refer to FIG. 7) is located between the light-emitting element and the light-receiving element of the optical sensor 113.

Figure 8:
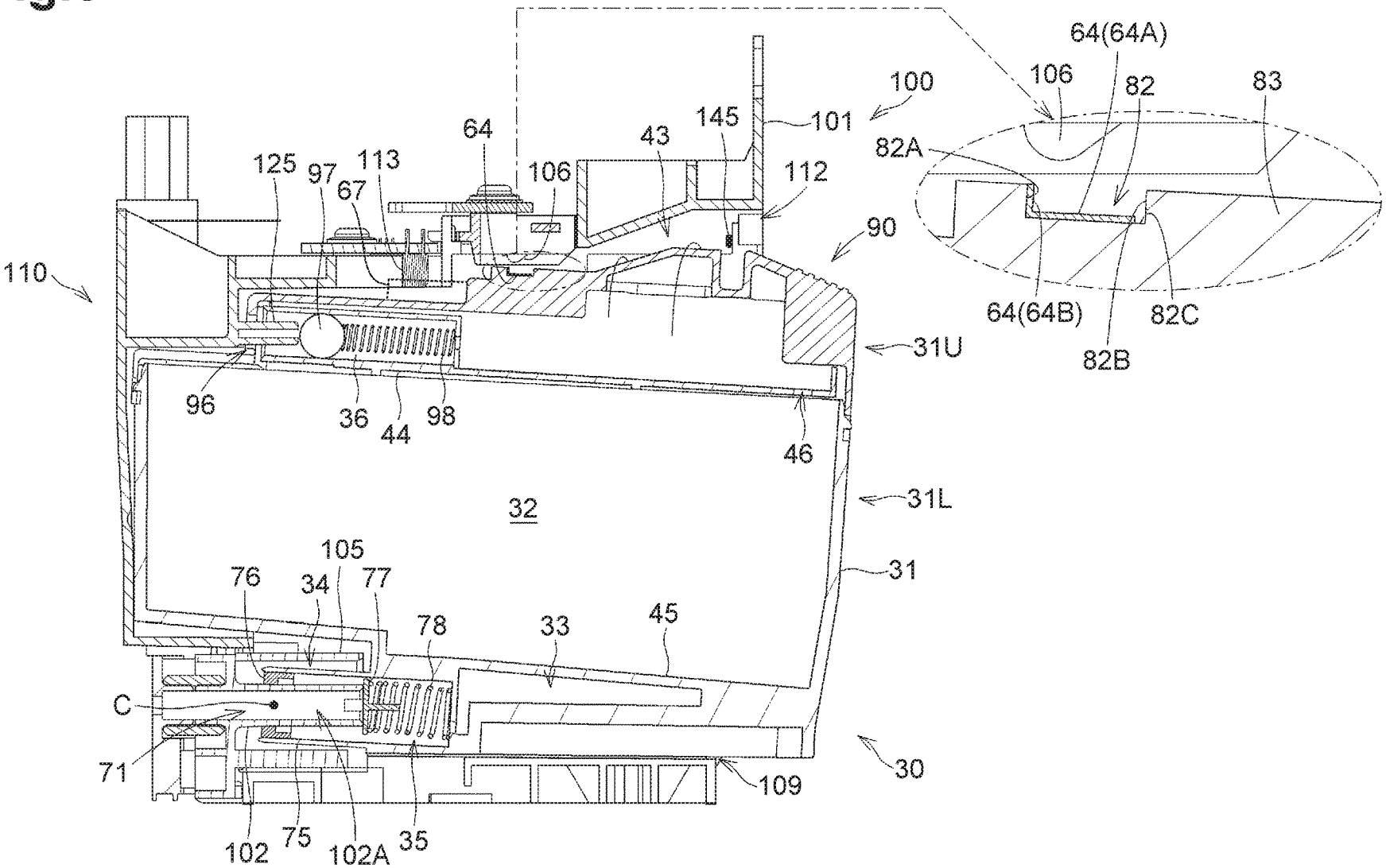
FIG. 8 is a vertical cross-sectional view of the ink cartridge attached to the cartridge-receiver in a second posture.

As the ink cartridge 30 is further being inserted into the cartridge holder 101 to a position near its end wall, as depicted in FIG. 8, the needle 102 enters the ink valve chamber 35 through the ink supply port 71, moving the valve 77 rearward away from the packing 76 against the biasing force of the coil spring 78. As a result, the needle 102 is coupled to the ink supply portion 34, and the interior space 102A of the needle 102 is brought into communication with the ink valve chamber 35 in the ink supply portion 34. The ink stored in the ink valve chamber 35 may flow into the interior space 102A. When the needle 102 is located in the ink valve chamber 35, an inner peripheral surface of the packing 76 defining the ink supply port 71 contacts an outer peripheral surface of the needle 102. In one example, the inner peripheral surface of the packing 76 fluid-tightly contacts the outer peripheral surface of the needle 102 in a circumferential direction of the packing 76. As the ink cartridge 30 moves in the insertion direction, the rod 125, which has entered the air communication port 96 and contacts the valve 97, moves the valve 97 rearward away from the air communication port 96 against the biasing force of the coil spring 98. As a result, the first chamber 32 is brought into communication with the atmosphere, via the through-hole 46, the air valve chamber 36, and the air communication port 96.

During the insertion of the ink cartridge 30 into the cartridge holder 101, the ink cartridge 30 may be applied with biasing forces of the compressed coil springs 78 and 98 acting in the rearward direction 52.

The protruding portion 43 moves below the shaft 145 and the sloping surface 155 may slidingly contact the shaft 145 during the insertion of the ink cartridge 30 into the cartridge holder 101. At this time, the needle 102 may enter the ink valve chamber 35, and the outer peripheral surface of the needle 102 may contact the inner peripheral surface of the packing 76.

The ink cartridge 30 may also be applied with a rotational moment acting in counterclockwise in FIG. 8, since the user pushes the upper portion 41U of the rear wall 41. Against the rotational moment, the contact between the sloping surface 155 and the shaft 145 may generate a rotation moment that causes the ink cartridge 30 to pivot about a center C of the ink supply port 71 of the packing 76 into which the needle 102 is inserted. The center C of the ink supply port 71 serves as a pivot center of the ink cartridge 30. In one example, during the movement of the ink cartridge 30 in the insertion direction, the sloping surface 155 passes underneath the shaft 145. At this time, the needle 102 is in contact with the inner peripheral surface of the packing 76, so that the ink cartridge 30 may pivot clockwise about the center C of the ink supply port 71 in the packing 76. Although the position of the pivot center of the ink cartridge 30 varies depending on the shape of the needle 102 and the shape of the ink supply port 71, the pivot center in the illustrative embodiment is the center of a portion at which the needle 102 contacts the inner peripheral surface of the tubular ink supply portion 34 (e.g., the inner peripheral surface of the packing 76 defining the ink supply port 71). The posture of the ink cartridge 30 that has thus pivoted clockwise about the pivot center (e.g., the posture illustrated in FIG. 8) is referred to as a second posture. When the ink cartridge 30 is in the second posture, the electrical contacts 106 are separated or spaced from the first surface 64A in up-down direction.

The bottom wall 42 of the casing 31 is angled relative to the front-rear direction. This configuration provides a space between the bottom wall 42 and the bottom wall of the cartridge holder 101 defining the guide groove 109. This space allows for the above-described clockwise pivotal movement of the ink cartridge 30. Further, the outside diameter of the rod 125 is smaller than the inside diameter of the air communication port 96. This configuration provides a space between the rod 125 and the air communication port 96. This space also allows for the above-described clockwise pivotal movement of the ink cartridge 30. In other words, the rod 125 and the air communication port 96 are not positioned relative to each other in the vertical or the up-down direction. The lower surface of the bottom wall 42 of the ink cartridge 30 need not be angled relative to the front-rear direction. For example, the ink cartridge 30 may include a stepped bottom wall 42 in which a rear end portion of the stepped bottom wall 42 is located higher than a front end portion of the stepped bottom wall 42, to provide a space between the stepped bottom wall 42 and the bottom wall of the cartridge holder 101 defining the guide groove 109.

When the ink cartridge 30 is in the second posture, a space is also provided between the electrodes 65 of the IC board 64 and the corresponding electrical contacts 106 in the up-down direction. That is, in the second posture of the ink cartridge 30 resulting from the clockwise pivotal movement, the electrodes 65 and the electrical contacts 106 are separated or spaced from each other in the up-down direction. In other words, the first surface 64A and the second surface 64B of the IC board 64 of the ink cartridge 30 that is in the second posture, are located below the electrical contacts 106 without contacting the electrical contacts 106.

As the ink cartridge 30, which is in the second posture, is further inserted in the frontward direction 51 against the biasing forces of the coil springs 78 and 98 acting in the rear direction 52, each of the sloping surface 155 and the horizontal surface 154 of the protruding portion 43 moves frontward beyond the shaft 145, reaching a position closer to the end wall of the cartridge holder 101 than the shaft 145, as depicted in FIG. 8.

The ink cartridge 30 may be applied with the rotational moment acting in the counterclockwise direction in FIG. 8 due to user's action of pushing the upper portion 41U of the rear wall 41. In a state where the sloping surface 155 and the horizontal surface 154 no longer contacts the shaft 145, the ink cartridge 30 is caused to pivot in the counterclockwise direction in FIG. 8 about the pivot center, which is the center C of the ink supply port 71 of the packing 76 through which the needle 102 is inserted. During the counterclockwise pivotal movement, the ink cartridge 30 may receive reaction forces of the coil springs 78 and 98. The counterclockwise pivotal movement of the ink cartridge 30 causes the first surface 64A of the IC board 64 to contact the electrical contacts 106 from below as depicted in FIG. 3, thereby positioning the IC board 64 relative to the electrical contacts 106 in the up-down direction.

At this time, the second surface 64B of the IC board 64 faces rearward and opposes the electrical contacts 106. When the user stops pushing the ink cartridge 30 in the frontward direction 51, the ink cartridge 30 may be moved rearward by the biasing forces of the coil springs 78 and 98. The rearward movement of the ink cartridge 30 causes the second surface 64B, which faces rearward and opposes the electrical contacts 106, to contact the electrical contacts 106 from the front. This contact between the second surface 64B and the electrical contacts 106 may restrict the ink cartridge 30 from moving further rearward. Positioning of the IC board 64 relative to the electrical contacts 106 in the front-rear direction may thus be achieved by the contact between the second surface 64B and the electrical contacts 106.

The IC board 64 is thus positioned in the up-down direction and the front-rear direction. As a result, the ink cartridge 30 may be held in position in the cartridge-receiver 110. The posture of the ink cartridge 30 illustrated in FIG. 3 is referred to as a first posture. Thus, attachment of the ink cartridge 30 to the cartridge-receiver 110 completes.

When the ink cartridge 30 is in the first posture, the first surface 64A is perpendicular to the up-down direction, and extends in the front-rear direction and the right-left direction. When the ink cartridge 30 is in the first posture, the second surface 64B is perpendicular to the front-rear direction, and extends in the up-down direction and the right-left direction.

The ink cartridge 30, when held in the cartridge holder 101, is configured to pivot between the first posture and the second posture about the pivot center (e.g., the center C).

When the ink cartridge 30 is in the first posture, the light blocking plate 67 is located between the light-emitting element and the light-receiving element of the optical sensor 113, thereby blocking the light from the light-emitting element toward the light-receiving element.

For removing the ink cartridge 30 from the cartridge-receiver 110, the user may push the operation surface 92 down. In the first posture of the ink cartridge 30, the operation surface 92 faces upward and rearward, so that, when the user operates the operation surface 92, a force acting downward and frontward is applied to the ink cartridge 30, thereby pivoting the ink cartridge 30 clockwise in FIG. 3 about the center C of the ink supply port 71. In this state, as depicted in FIG. 8, the second surface 64B of the IC board 64 is located below the lower ends of the electrical contacts 106, and the protruding portion 43 is located below the shaft 145. That is, the ink cartridge 30 is moved from the first posture to the second posture. The ink cartridge 30 may be moved rearward relative to the cartridge-receiver 110 due to the biasing forces of the coil springs 78 and 98, out of the cartridge-receiver 110.

[Determination as to Whether Ink Cartridge 30 is Attached to Cartridge-Receiver 110]

Referring to flowcharts depicted in FIGS. 9 and 10, determination as to whether the ink cartridge 30 is attached to the cartridge-receiver 110 will be described below. Processes depicted in FIGS. 9 and 10 may be executed by the CPU of the controller 1, for example, by reading out programs stored in the ROM, or may be executed by a hardware circuit of the controller 1. The order in which the processes are performed may be changed as desired without departing from the scope of the invention.

The flowchart depicted in FIG. 9 will now be described.

A user may pivot the cover 114, which closes the opening 112 of the cartridge holder 101, from the closed position to the open position, to install or attach, for example, the ink cartridge 30, to the cartridge-receiver 110. Based on the movement of the cover 114 from the closed position to the open position, a signal output from the cover sensor 118 will change from the first signal to the second signal. Based on the change in the signals output from the cover sensor 118, the controller 1 (refer to FIG. 1) determines that the cover 114 is not in the closed position (e.g., is in the open position) (S100: No). The controller 1 repeats step S100 until the cover 114 is closed (e.g., placed in the closed position).

After attaching an ink cartridge (e.g., the ink cartridge 30 or a different type of an ink cartridge) to the cartridge-receiver 110, the user may pivot the cover 114 from the open position to the closed position. As the cover 114 reaches the closed position, a signal output from the cover sensor 118 will change from the second signal to the first signal. Based on the change in the signals output from the cover sensor 118, the controller 1 determines that the cover 114 is in the closed position (S100: Yes). Based on no change in the signal output from the cover sensor 118, the controller 1 determines that the cover 114 is in the open position (S100: No).

Based on the controller 1 determining in S100 that the cover 114 is in the closed position, the controller 1 determines whether data is readable from the IC board 64 of the ink cartridge (S110). When the electrical contacts 106 are in contact and electrically connected with the IC board 64, the controller 1 can read data from the IC board 64. When the electrical contacts 106 do not contact the IC board 64, the controller 1 cannot read data from the IC board 64. Based on the controller 1 determining that data is not readable from the IC board 64 (S110: No), the controller 1 determines that the cartridge-receiver 110 has not received an ink cartridge (S120). In such case, the controller 1 may cause a display (not depicted) provided at a casing of the printer 10 to display a message, and/or a speaker (not depicted) of the printer 10 to issue sounds, e.g., buzzer, thereby notifying the user that no ink cartridge is attached to the cartridge-receiver 110.

Based on the controller 1 determining that data is readable from the IC board 64 (S110: Yes), the controller 1 determines whether a signal output from the optical sensor 113 to the controller 1 is at a high level or low level. The optical sensor 113 is configured to output to the controller 1 a low level signal when the light blocking plate 67 is located between the light-emitting element and the light-receiving element of the optical sensor 113, and a high level signal when the light blocking plate 67 is not located between the light-emitting element and the light-receiving element.

Based on the controller 1 determining that the signal output from the optical sensor 113 to the controller 1 is at the high level (S130: High), the controller 1 determines that the cartridge-receiver 110 has received a type of an ink cartridge different from the ink cartridge 30 (S140). In such case, the controller 1 may cause the display (not depicted) of the printer 10 to display a message, and/or the speaker (not depicted) of the printer 10 to issue sounds, e.g., buzzer, thereby notifying the user that a different type of an ink cartridge is attached to the cartridge-receiver 110.

Based on the controller 1 determining that the signal output from the optical sensor 113 to the controller 1 is at the low level (S130: Low), the controller 1 determines that the cartridge-receiver 110 has received the ink cartridge 30 (S150).

Figure 9:
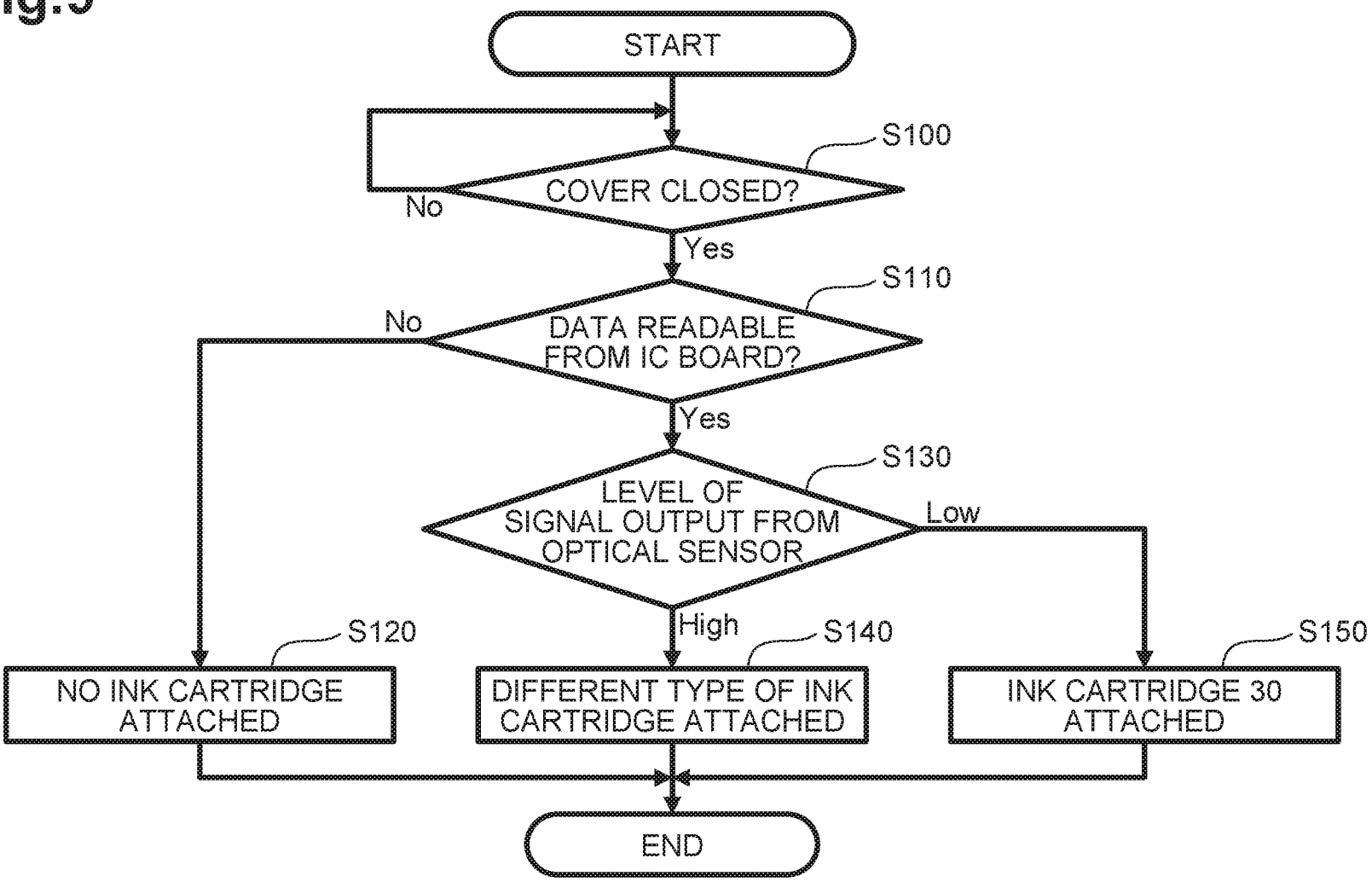
FIG. 9 is a flowchart illustrating steps of a process, in an illustrative embodiment according to one or more aspect of the disclosure, performed to determine whether the ink cartridge is attached to the cartridge-receiver.

In the flowchart of FIG. 9, the controller 1 determines whether the cartridge-receiver 110 has received an ink cartridge, based on whether data is readable from the IC board 64, and subsequently determines whether the ink cartridge received in the cartridge-receiver 110 is the ink cartridge 30, based on the level of a signal output from the optical sensor 113.

In another example, the controller 1 may determine whether the cartridge-receiver 110 has received an ink cartridge, based on levels of signals output from the optical sensor 113, and subsequently determines whether the ink cartridge received in the cartridge-receiver 110 is the ink cartridge 30, based on whether data is readable from the IC board 64. Such example will now be described in detail below referring to the flowchart of FIG. 10.

Figure 10:
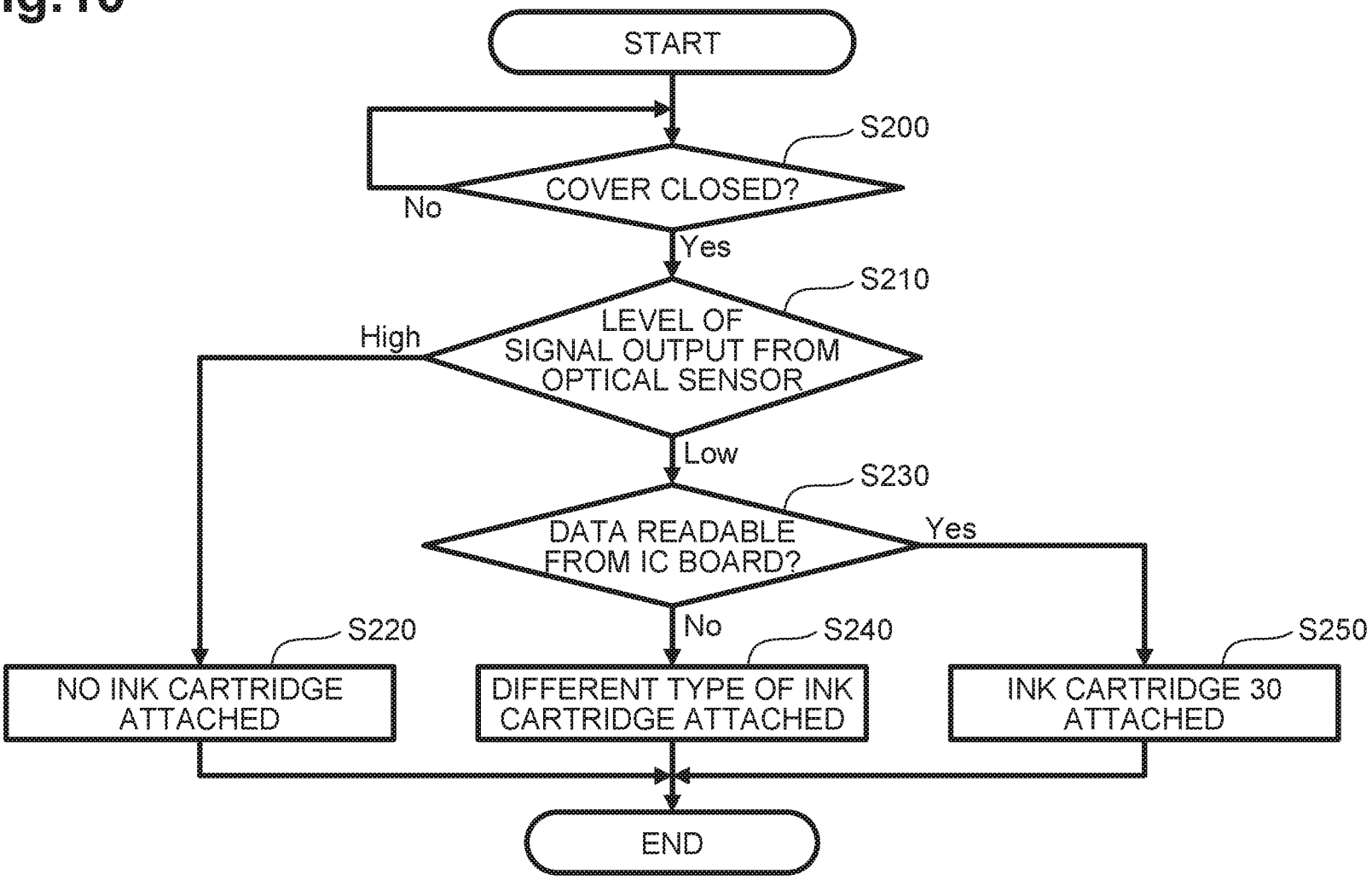
FIG. 10 is a flowchart illustrating steps of a process, in an illustrative embodiment according to one or more aspect of the disclosure, performed to determine whether the ink cartridge is attached to the cartridge-receiver.

As depicted in FIG. 10, similar to step S100 of FIG. 9, the controller 1 determines in S200, whether the cover 114, which has moved to the open position, is moved to the closed position, based on the change in signals output from the cover sensor 118. Based on the controller 1 determining in S200 that the cover 114 is moved to the closed position (S200: Yes), the controller 1 determines whether a signal output from the optical sensor 113 to the controller 1 is at the high level or the low level (S210).

Based on the controller 1 determining that the signal output from the optical sensor 113 to the controller 1 is at the high level (S210: High), the controller 1 determines that the cartridge-receiver 110 has not received an ink cartridge (S220). In such case, similar to step S120 in FIG. 9, the controller 1 may cause the display (not depicted) of the printer 10 to display a message, and/or the speaker (not depicted) of the printer 10 to issue sounds, e.g., buzzer, thereby notifying the user that no ink cartridge is attached to the cartridge-receiver 110.

Based on the controller 1 determining that the signal output from the optical sensor 113 to the controller 1 is at the low level (S210: Low), the controller 1 subsequently determines whether data is readable from an IC board of the ink cartridge (S230).

When the controller 1 determines that data is not readable the IC board of the ink cartridge (S230: No), the controller 1 determines that the cartridge-receiver 110 has received a type of an ink cartridge different from the ink cartridge 30 (S240). In such case, similar to step S140 in FIG. 9, the controller 1 controls relevant components (e.g., the display and/or the speaker) to provide the user with such a notification that a different type of an ink cartridge is attached to the cartridge-receiver 110.

When the controller 1 determines that data is readable from the IC board 64 (S230: Yes), the controller 1 determines that the cartridge-receiver 110 has received the ink cartridge 30 (S250).

Effects of Illustrative Embodiment

In the illustrative embodiment, when the ink cartridge 30 is in the first posture, the second surface 64B contacts the electrical contacts 106, thereby holding the ink cartridge 30 in the first posture.

In the illustrative embodiment, the IC board 64 includes at least one of the first surface 64A and the second surface 64B. When the ink cartridge 30 is in the first posture, the first surface 64A facing upward, and the second surface 64B facing rearward may both contact the electrical contacts 106, thereby establishing electrical connection between the IC board 64 and the electrical contacts 106, and holding the ink cartridge 30 in the first posture relative to the cartridge-receiver 110 against the biasing force acting in the rearward direction 52. The establishment of electrical connection between the IC board 64 and the electrical contacts 106 and the positioning of the ink cartridge 30 relative to the cartridge-receiver 110 may thus be achieved by the contact between the electrical contacts 106 and the first and second surfaces 64A and 64B. Accordingly, the IC board 64 may be positioned with accuracy relative to the electrical contacts 106.

In the illustrative embodiment, the ink cartridge 30 is configured to pivot between the first posture and the second posture. The first surface 64A of the ink cartridge 30 in the first posture is located higher than the second surface 64B of the ink cartridge 30 in the second posture. A direction in which the first surface 64A moves during the movement of the ink cartridge 30 from the second posture to the first posture is toward the electrical contacts 106. The first surface 64A may be readily brought into contact with the electrical contacts 106 when the ink cartridge 30 pivots from the second posture to the first posture and the ink cartridge 30 may thus be positioned in the up-down direction readily.

In the illustrative embodiment, when the ink cartridge 30 is in the first posture, the IC board 64 may contact with a respective one of the electrical contacts 106 at two locations, thereby positioning the IC board 64. More specifically, the second surface 64B contacts a set of electrical contacts 106 from the front, thereby positioning the IC board 64 in the front-rear direction, and the first surface 64A contacts the set of the electrical contacts 106 from below, thereby positioning the IC board 64 in the up-down direction.

In the illustrative embodiment, the electrical contact 106 contacts the corresponding electrode 65 of the IC board 64 at two locations, thereby stabilizing electrical contact between the electrical contact 106 and the electrode 65. For example, if dust and/or foreign materials are attached to a portion of the electrode 65 located on one of the first surface 64A and the second surface 64B, another portion of the electrode 65 located on the other one of the first surface 64A and the second surface 64B can electrically connect to the electrical contact 106.

In the illustrative embodiment, the second surface 64B is perpendicular to the front-rear direction. This configuration may reduce such a possibility that the ink cartridge 30 held in position in the cartridge-receiver 110 comes out of the section 110, as compared with the configuration of an ink cartridge 30 having a second surface 64B that is not perpendicular to the front-rear direction in a state in which the ink cartridge 30 is in the first posture.

In the illustrative embodiment, the first surface 64A is perpendicular to the up-down direction. With this configuration, the IC board 64 may be positioned in the up-down direction with higher accuracy, as compared with an ink cartridge 30 having a first surface 64A that is not perpendicular to the up-down direction in a state in which the ink cartridge 30 is in the first posture.

In the illustrative embodiment, the ink cartridge 30 is configured to pivot between the first posture and the second posture about a contact portion between the packing 76 and the needle 102. The ink cartridge 30 can pivot between the first posture and the second posture with simple configuration.

[First Modification]

In the illustrative embodiment, when the ink cartridge 30 is in the first posture, the first surface 64A is perpendicular to the up-down direction and the second surface 64B is perpendicular to the front-rear direction. In another embodiment, when the ink cartridge 30 is in the first posture, the first surface 64A may face upward (e.g., face in a direction including an upward component) but not perpendicular to the up-down direction; and the second surface 64B may face rearward (e.g., face in a direction including a rearward component) but not perpendicular to the front-rear direction.

Figure 11:
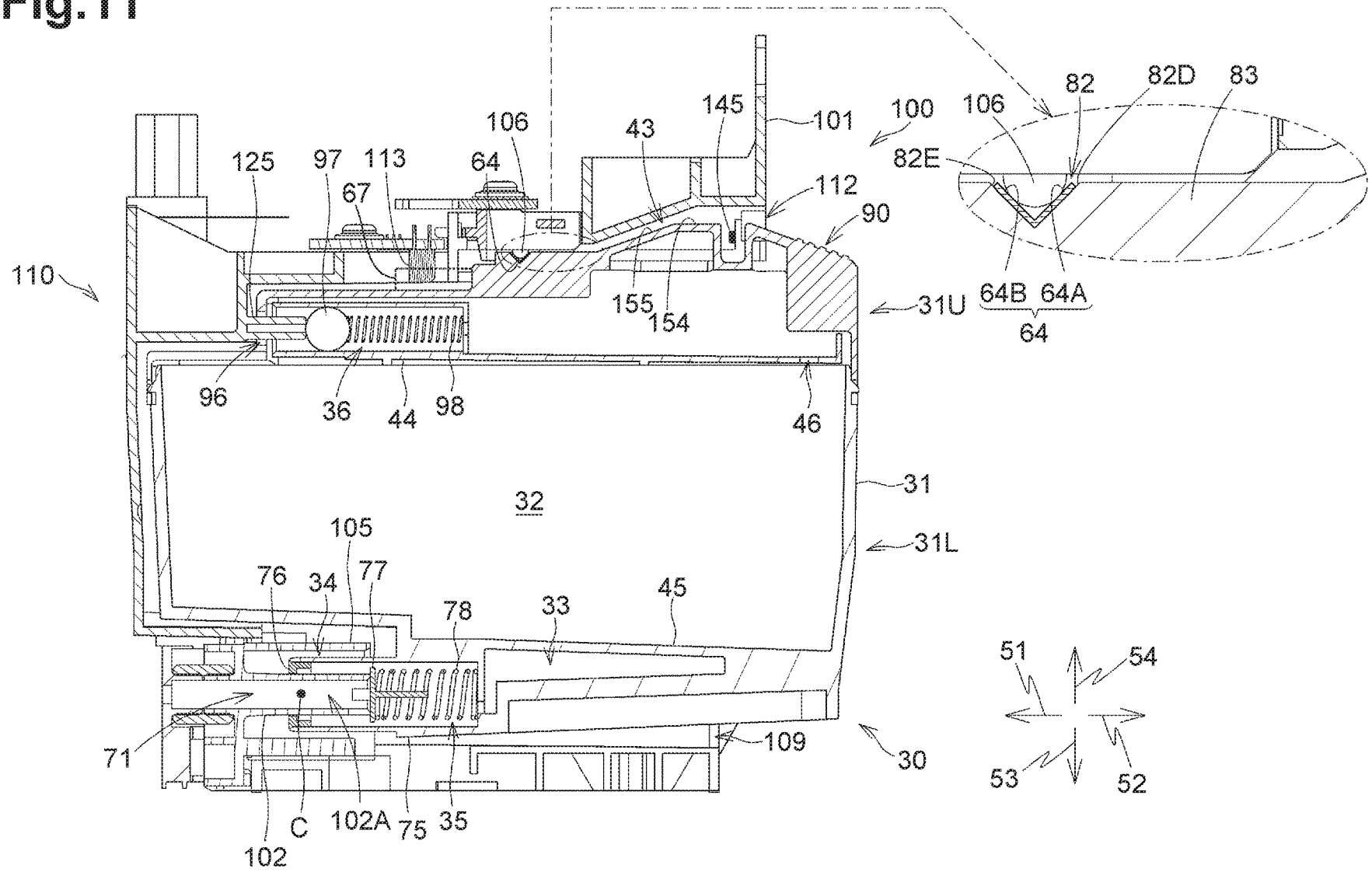
FIG. 11 is a vertical cross-sectional view of an ink cartridge, in a first modification according to one or more aspects of the disclosure, attached to the cartridge-receiver in the first posture.

For example, the protruding portion 83 may have such a recessed portion 82 as depicted in FIG. 11. The recessed portion 82 is defined by a first inclined surface 82D and a second inclined surface 82E. The first inclined surface 82D faces frontward and upward and a front end of the first inclined surface 82D is continuous with the second inclined surface 82E. The second inclined surface 82E faces rearward and upward. The IC board 64 may be attached to the first inclined surface 82D and the second inclined surface 82E. The IC board 64 attached to the first inclined surface 82D and the second inclined surface 82E includes a first surface 64A and a second surface 64B. The first surface 64A faces a direction opposite a direction that a surface of the IC board 64 attached to the first inclined surface 82D faces. The second surface 64B faces a direction opposite a direction that a surface of the IC board 64 attached to the second inclined surface 82E faces.

When the ink cartridge 30 is in the first posture as depicted in FIG. 11, the first surface 64A contacts the electrical contacts 106 obliquely from the rear and below and the second surface 64B contacts the electrical contacts 106 obliquely from the front and below.

[Second Modification]

In the illustrative embodiment and the first modification, the IC board 64 includes the first surface 64A and the second surface 64B, each configured to contact the electrical contacts 106. In another embodiment, the IC board 64 may include at least one of the first surface and the second surface. For example, one of the first surface and the second surface may be disposed at the IC board 64, while the other one of the first surface and the second surface may be disposed at a surface of the ink cartridge 30 different from surfaces of the IC board 64 (e.g., a surface defining the recessed portion 82).

Figure 12:
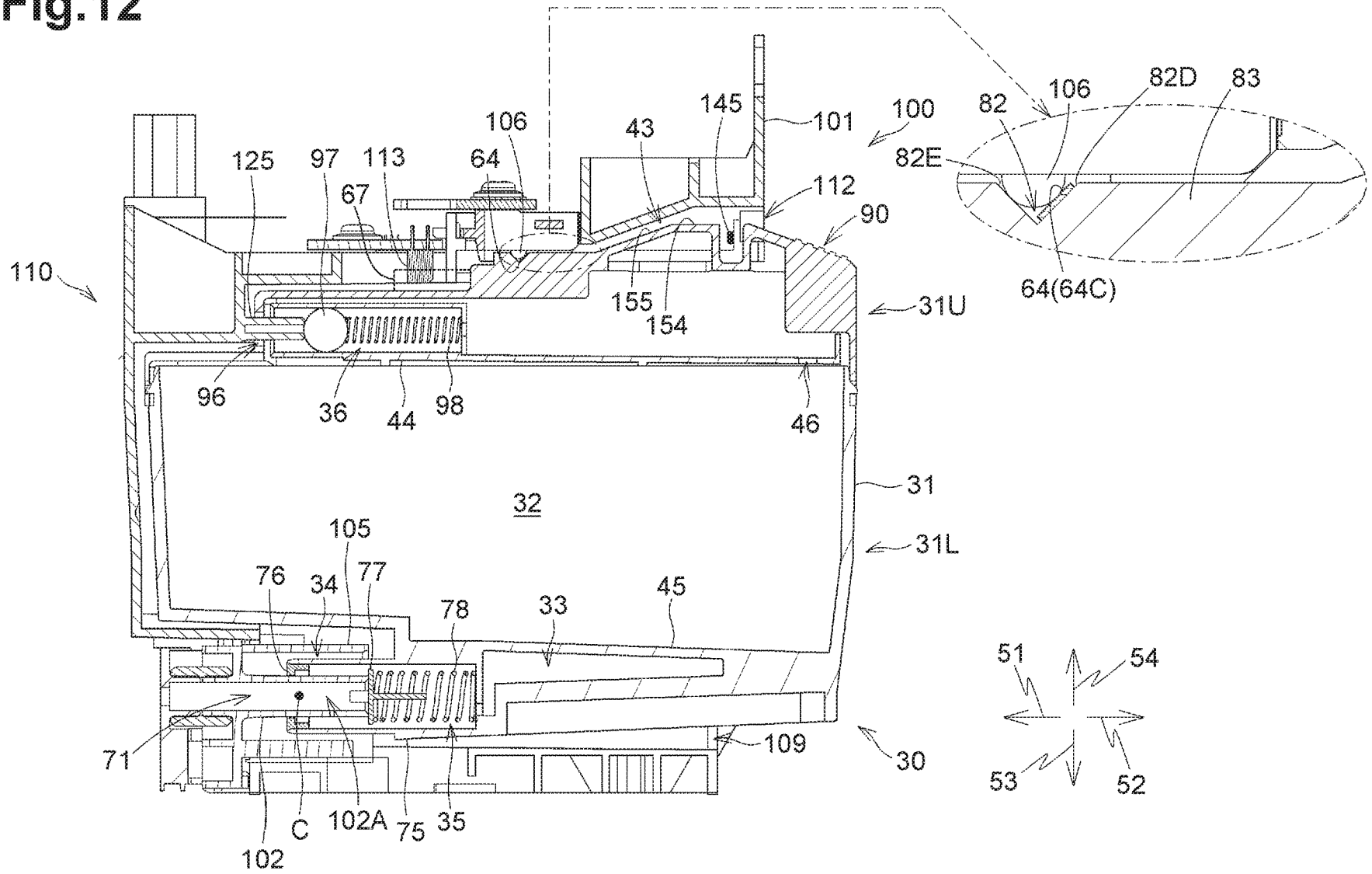
FIG. 12 is a vertical cross-sectional view of an ink cartridge, in a second modification according to one or more aspects of the disclosure, attached to the cartridge-receiver in the first posture.

For example, as depicted in FIG. 12, the IC board 64 may be attached to the first inclined surface 82D of the recessed portion 82 but not attached to the second inclined surface 82E. When the ink cartridge 30 is in the first posture, the electrical contacts 106 may contact an upper surface 64C of the IC board 64 (facing frontward and upward) and the second inclined surface 82E of the recessed portion 82. In this configuration, the upper surface 64C of the IC board 64 is an example of the first surface and the second inclined surface 82E of the recessed portion 82 is an example of the second surface.

Figure 13:
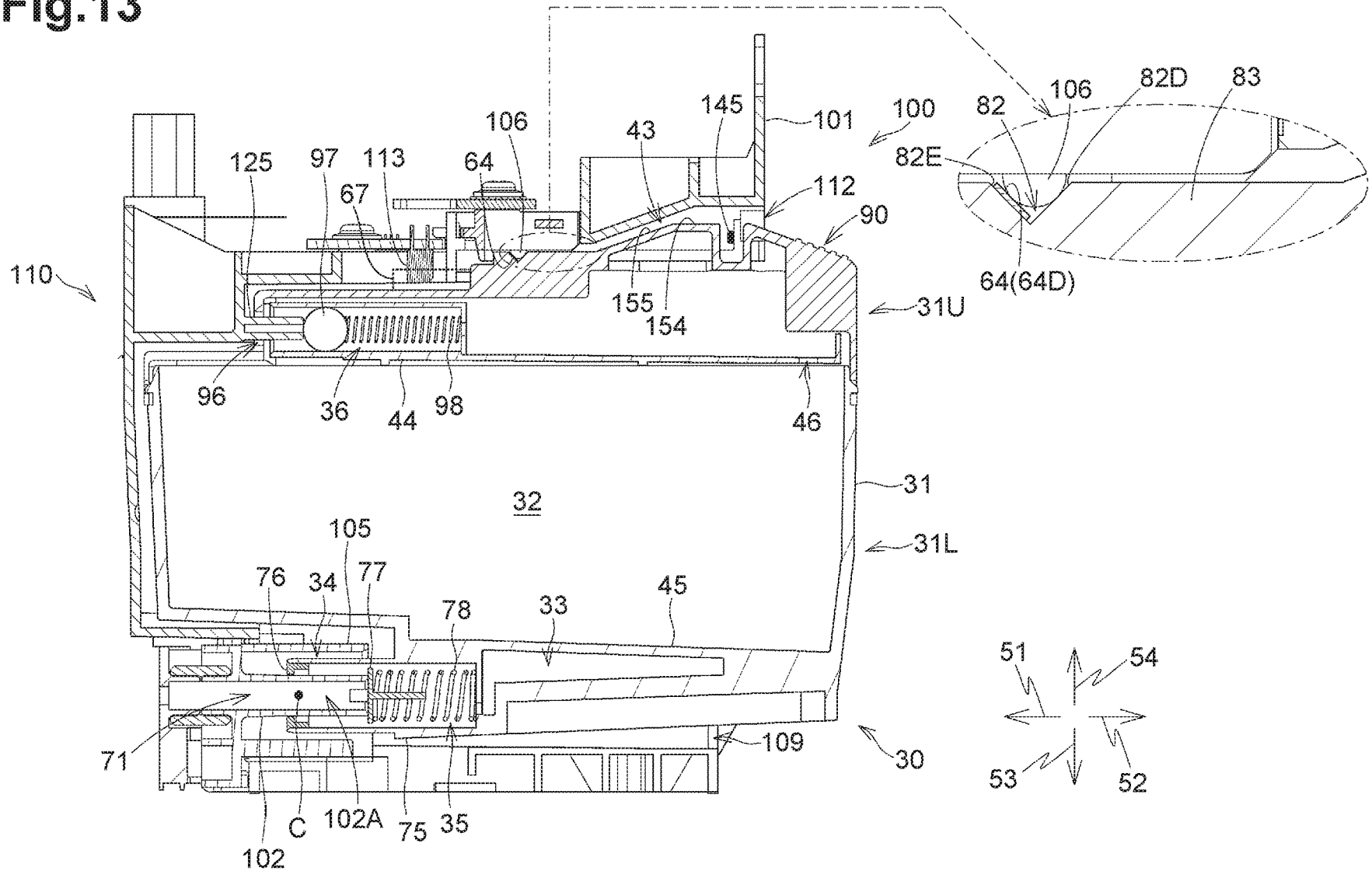
FIG. 13 is a vertical cross-sectional view of an ink cartridge, in a second modification according to one or more aspects of the disclosure, attached to the cartridge-receiver in the first posture.

For example, as depicted in FIG. 13, the IC board 64 may be attached to the second inclined surface 82E of the recessed portion 82 but not attached to the first inclined surface 82D. When the ink cartridge 30 is in the first posture, the electrical contacts 106 may contact an upper surface 64D of the IC board 64 (facing rearward and upward) and the first inclined surface 82D of the recessed portion 82. In this configuration, the first inclined surface 82D of the recessed portion 82 is an example of the first surface and the upper surface 64D of the IC board 64 is an example of the second surface.

In the second modification, the IC board 64 may be disposed without bending. Accordingly, the IC board 64 may not necessarily be a flexible board, but may be, for example, a rigid glass-epoxy board.

In the configuration depicted in FIG. 12, the electrical contacts 106 located in the recessed portion 82, each contact the ink cartridge 30 at two locations. One of the locations is at the second inclined surface 82E and the other one of the locations is at the upper surface 64C of the IC board 64. The second inclined surface 82E and the upper surface 64C are arranged in the front-rear direction. With this configuration, the IC board 64 may be positioned relative to the electrical contacts 106 with higher accuracy, as compared with a configuration in which each electrical contact 106 contacts the IC board 64 of the ink cartridge 30 at one location.

In the configuration depicted in FIG. 13, the IC board 64 (e.g., the upper surface 64D) contacts the electrical contact 106, thereby establishing electrical connection between the IC board 64 and the electrical contact 106 and holding of the ink cartridge 30 in position. In this way, establishment of the electrical connection and the holding of the ink cartridge 30 may be achieved by the contact between the upper surface 64D of the IC board 64 and the electrical contact 106 at one location. This configuration may achieve accurate positioning of the IC board 64 relative to the electrical contacts 106.

[Third Modification]

Figure 14:
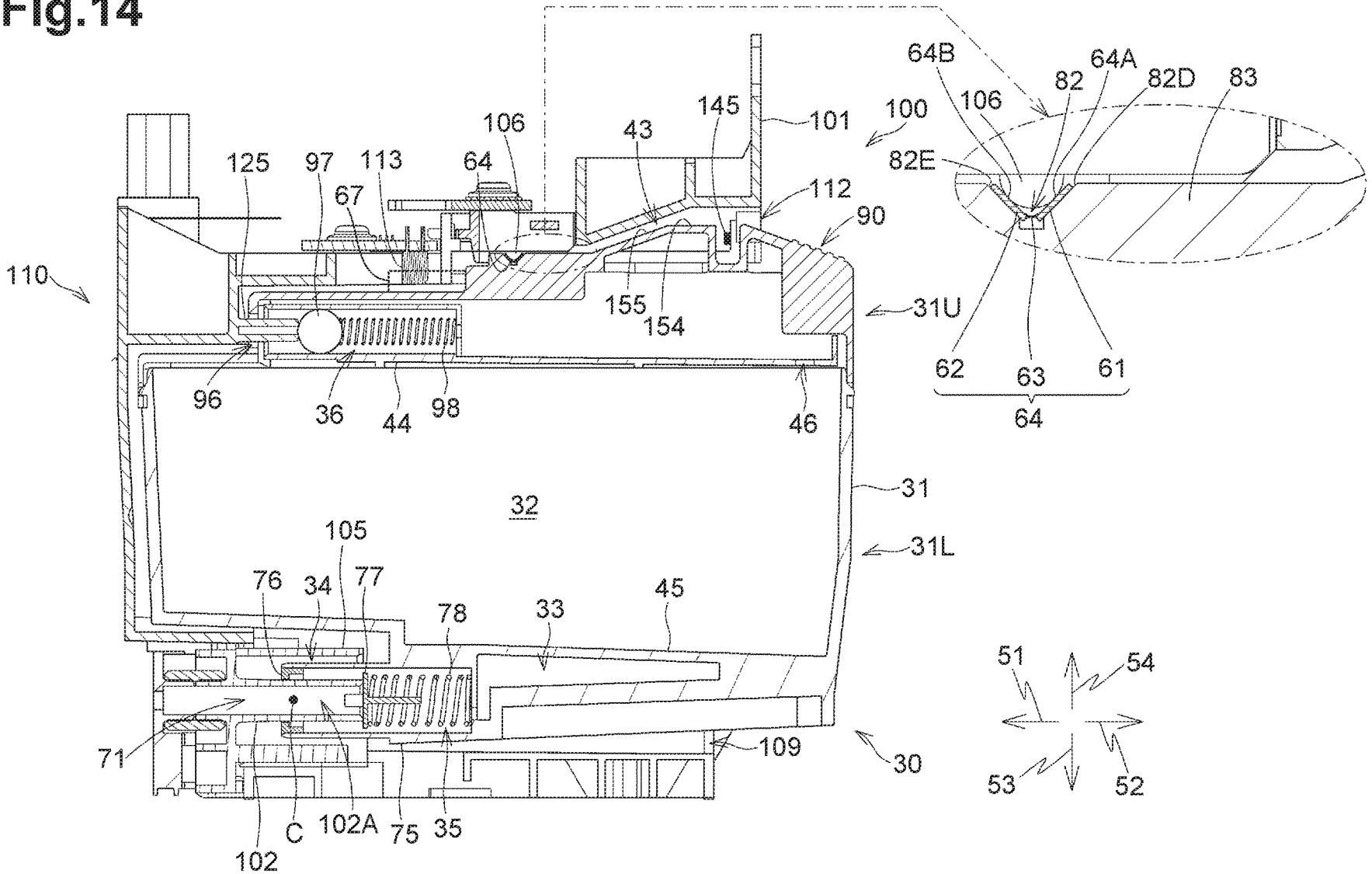
FIG. 14 is a vertical cross-sectional view of an ink cartridge, in a third modification according to one or more aspects of the disclosure, attached to the cartridge-receiver in the first posture.

The IC board 64 may be a combination of a flexible board and a rigid board. For example, as depicted in FIG. 14, the IC board 64 includes a first board 61 and a second board 62 that are rigid boards, and a third board 63 that is a flexible board. Each of the first board 61, the second board 62, and third board 63 includes electrodes 65. Portions of the third board 63 having the electrodes 65 may be partially attached to the first board 61 and the second board 62. Another portion of the third board 63 may be disposed between a first surface 64A and a second surface 64B while bending or curving. The first surface 64A may be a surface of the first board 61 having the electrodes 65. The second surface 64B may be a surface of the second board 62 having the electrodes 65.

The IC board 64 may include a connecting member, such as a lead wire, instead of the third board 63. The electrodes 65 of each board 61, 62 may be electrically connected by the connecting member. In the configurations in which the first board 61 and the second board 62 are electrically connected by the third board 63 or by the connecting member, the first surface 64A and the second surface 64B may be separated. In other words, the first surface 64A and the second surface 64B may not necessarily be continuous.

[Fourth Modification]

In the illustrative embodiment and the first, second and third modifications, each of the electrical contacts 106 contacts the ink cartridge 30 in the first posture at two locations (e.g., at the first surface and the second surface of the ink cartridge 30).

Alternatively, each of the electrical contacts 106 may contact the ink cartridge 30 in the first posture at one location.

Figure 15:
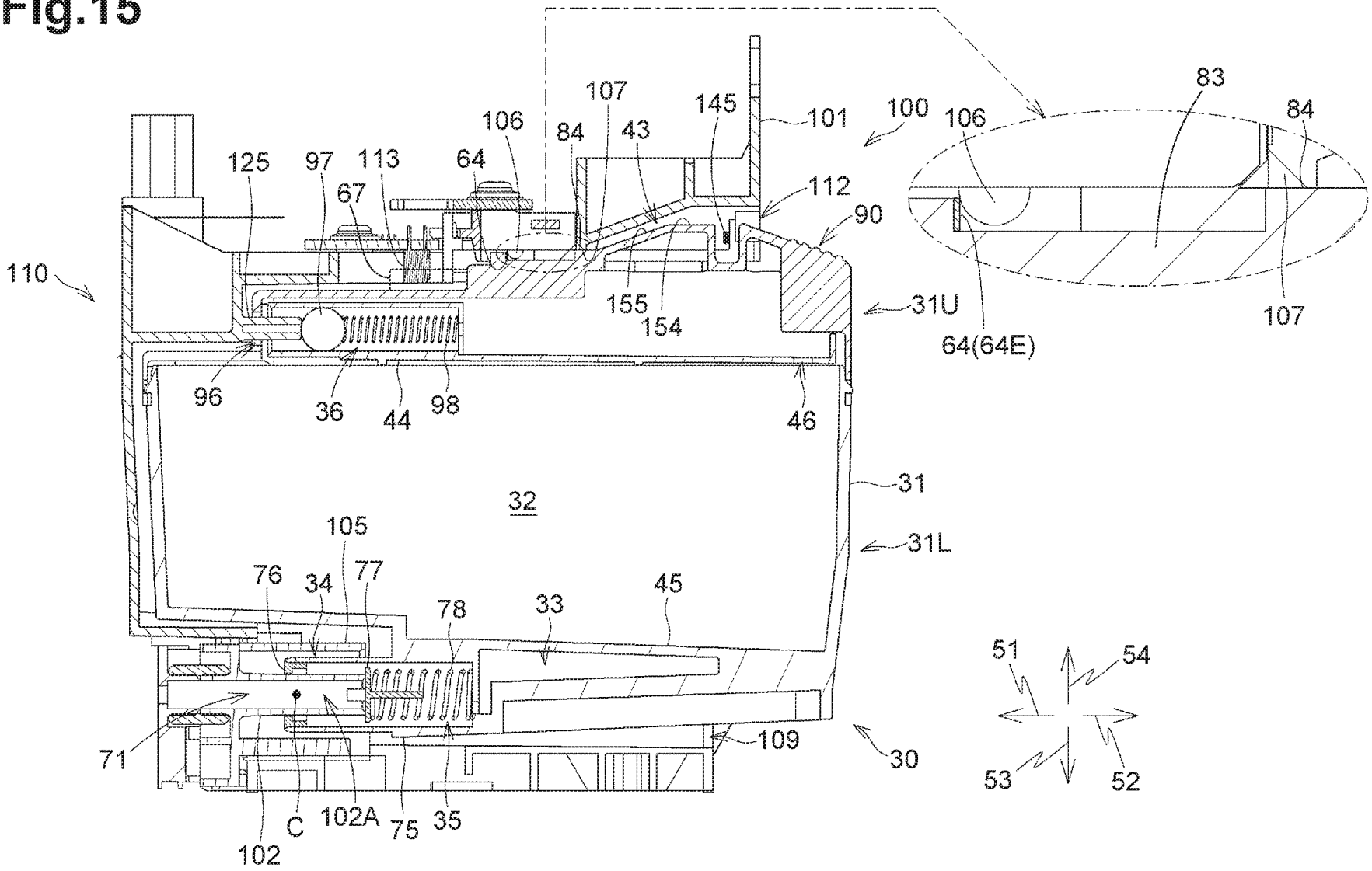
FIG. 15 is a vertical cross-sectional view of an ink cartridge, in a fourth modification according to one or more aspects of the disclosure, attached to the cartridge-receiver in the first posture.
Figure 16:
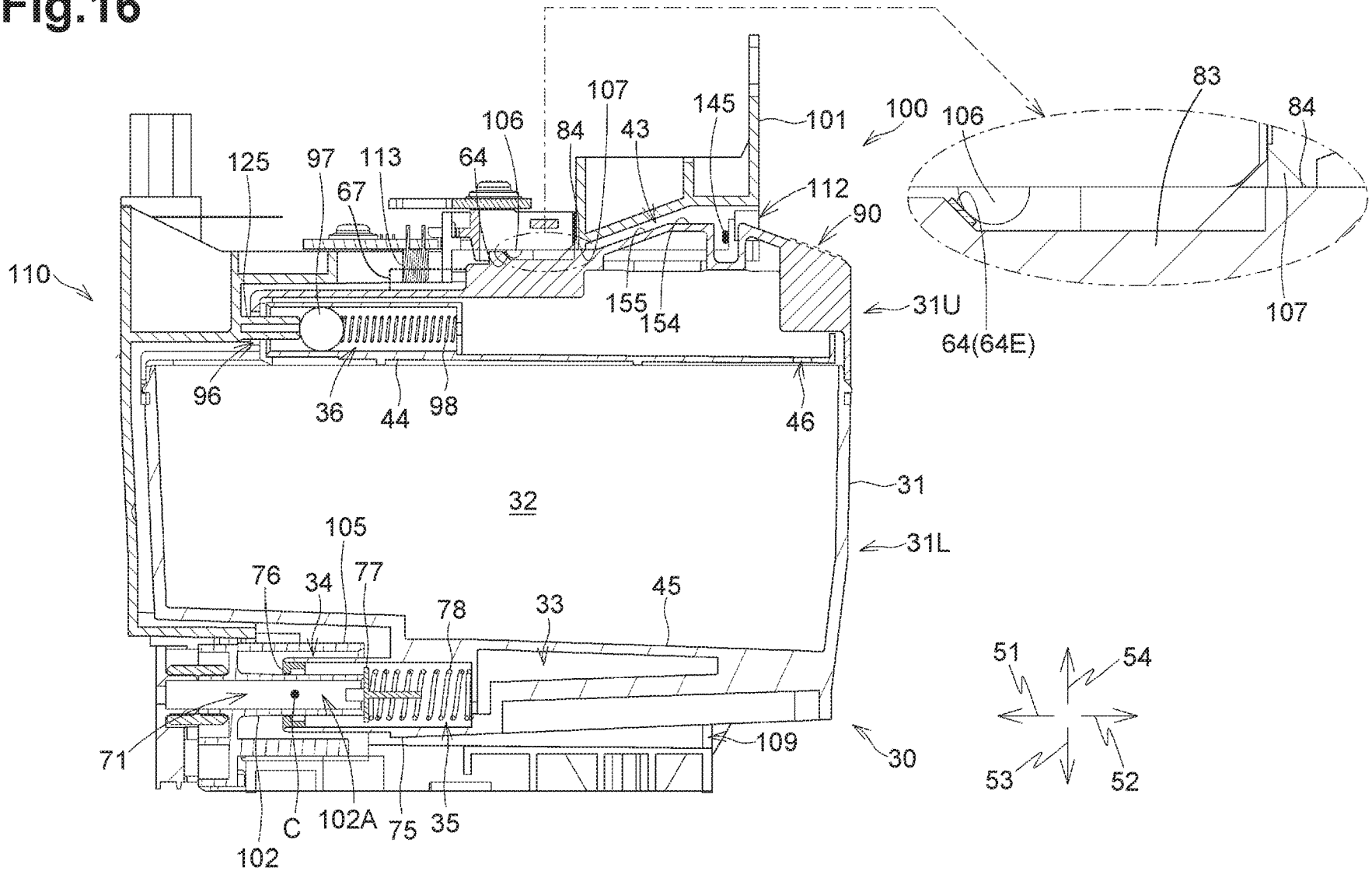
FIG. 16 is a vertical cross-sectional view of an ink cartridge, in a fourth modification according to one or more aspects of the disclosure, attached to the cartridge-receiver in the first posture.

For example, as depicted in FIGS. 15 and 16, the IC board 64 may be attached to the ink cartridge 30 such that a rear surface 64E of the IC board 64 faces rearward. When the ink cartridge 30 is in the first posture, the rear surface 64E contacts a particular portion of the electrical contact 106 from the front. Other portion of the electrical contact 106 than the particular portion may not necessarily contact the ink cartridge 30.

In the examples depicted in FIGS. 15 and 16, the cartridge-receiver 110 includes a positioning surface 107 disposed at a portion near the top wall of the cartridge holder 101 between the set of the electrical contacts 106 and the shaft 145. The protruding portion 83 of the ink cartridge 30 includes a contact surface 84 disposed to the rear of the IC board 64. The contact surface 84 faces upward. When the ink cartridge 30 has been attached to the cartridge-receiver 110, the contact surface 84 contacts the positioning surface 107, thereby positioning the ink cartridge 30 in the up-down direction.

When the ink cartridge 30 is in the first posture, the rear surface 64E may or may not be perpendicular to the front-rear direction as depicted in FIGS. 15 and 16, respectively. An ink cartridge 30 depicted in FIG. 16 includes, at its upper surface, a stepped portion having a slope surface on which the IC board 64 is disposed. The slope surface is an inclined surface facing upward and rearward. In the fourth modification, the IC board 64 may be disposed without bending. Accordingly, the IC board 64 may not necessarily be a flexible board similar to the second modification.

In the fourth modification, when the ink cartridge 30 is in the first posture, the rear surface 64E contacts the electrical contact 106 from the front. This configuration may restrict the movement of the ink cartridge 30 in the front-rear direction against the biasing forces of the coil springs 78 and 98 acting in the removal direction, thereby holding the ink cartridge 30 in the first posture.

In the fourth modification, the ink cartridge 30 is configured to pivot between the first posture and the second posture in the cartridge holder 101. The contact surface 84 of the ink cartridge 30 in the second posture is located lower than the contact surface 84 of the ink cartridge 30 in the first posture. When the ink cartridge 30 pivots from the second posture to the first posture, the contact surface 84 moves toward the positioning surface 107. By bringing the contact surface 84 into contact with the positioning surface 107, the ink cartridge 30 may be positioned in the up-down direction readily.

In the fourth modification, the IC board 64 includes the rear surface 64E. The rear surface 64E may contact the electrical contacts 106, thereby establishing electrical connection between the IC board 64 and the electrical contacts 106, and holding the ink cartridge 30 in position. The IC board 64 may thus be positioned with accuracy relative to the electrical contacts 106.

In an example of the fourth modification as depicted in FIG. 15, the rear surface 64E is perpendicular to the front-rear direction, e.g., the removal direction of the ink cartridge 30. This configuration may reduce such a possibility that the ink cartridge 30 held in position in the cartridge-receiver 110 comes out of the section 110, as compared with the configuration of the ink cartridge 30 as depicted in FIG. 16, that is, the rear surface 64E is not perpendicular to the front-rear direction in a state in which the ink cartridge 30 is in the first posture.

[Other Modifications]

In the illustrative embodiment and the modifications, the casing 31 includes the protruding portion 83. In another embodiment, the casing 31 may not include the protruding portion 83. In this configuration, for example, the top wall 39 of the casing 31 may have the recessed portion 82 formed at an upper surface thereof.

Figure 17:
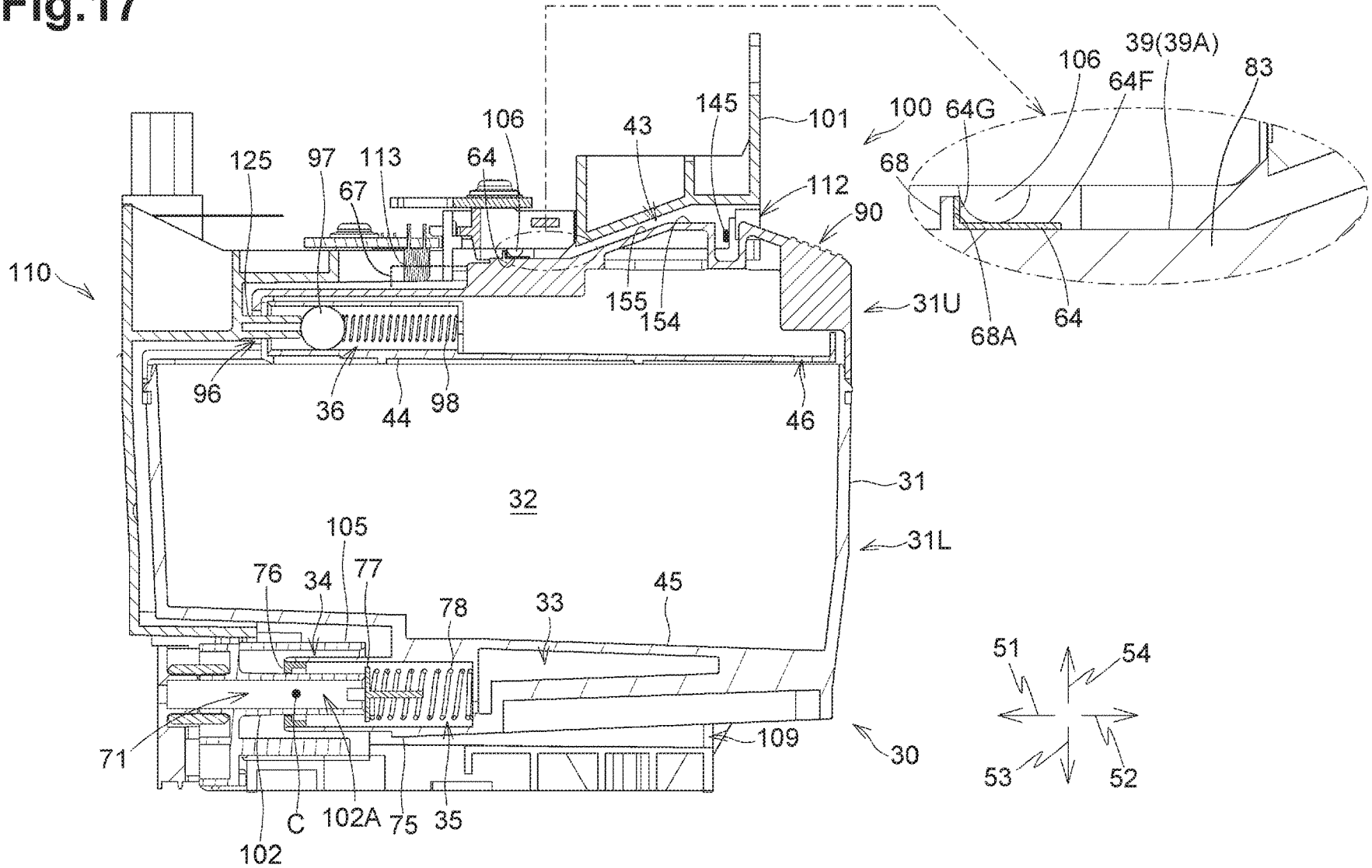
FIG. 17 is a vertical cross-sectional view of an ink cartridge, in a modification according to one or more aspects of the disclosure, attached to the cartridge-receiver in the first posture.

In the illustrative embodiment, the ink cartridge 30 includes the recessed portion 82. In another embodiment, the ink cartridge 30 may not include the recessed portion 82. For example, as depicted in FIG. 17, the protruding portion 83 of the ink cartridge 30 may include a protrusion 68 protruding upward from an upper surface thereof. The protrusion 68 includes a rear surface 68A. The top wall 39 may include an upper surface 39A extending rearward from a lower end of the rear surface 68A. The IC board 64 may be attached to the rear surface 68A and the upper surface 39A. When the ink cartridge 30 is in the first posture, the electrical contacts 106 may contact a first surface 64F and a second surface 64G of the IC board 64. The first surface 64F faces a direction opposite a direction that a surface of the IC board 64 attached to the upper surface 39A faces. The first surface 64F faces upward. The second surface 64G faces a direction opposite a direction that a surface of the IC board 64 attached to the rear surface 68A faces. The second surface 64G faces rearward.

Figure 18:
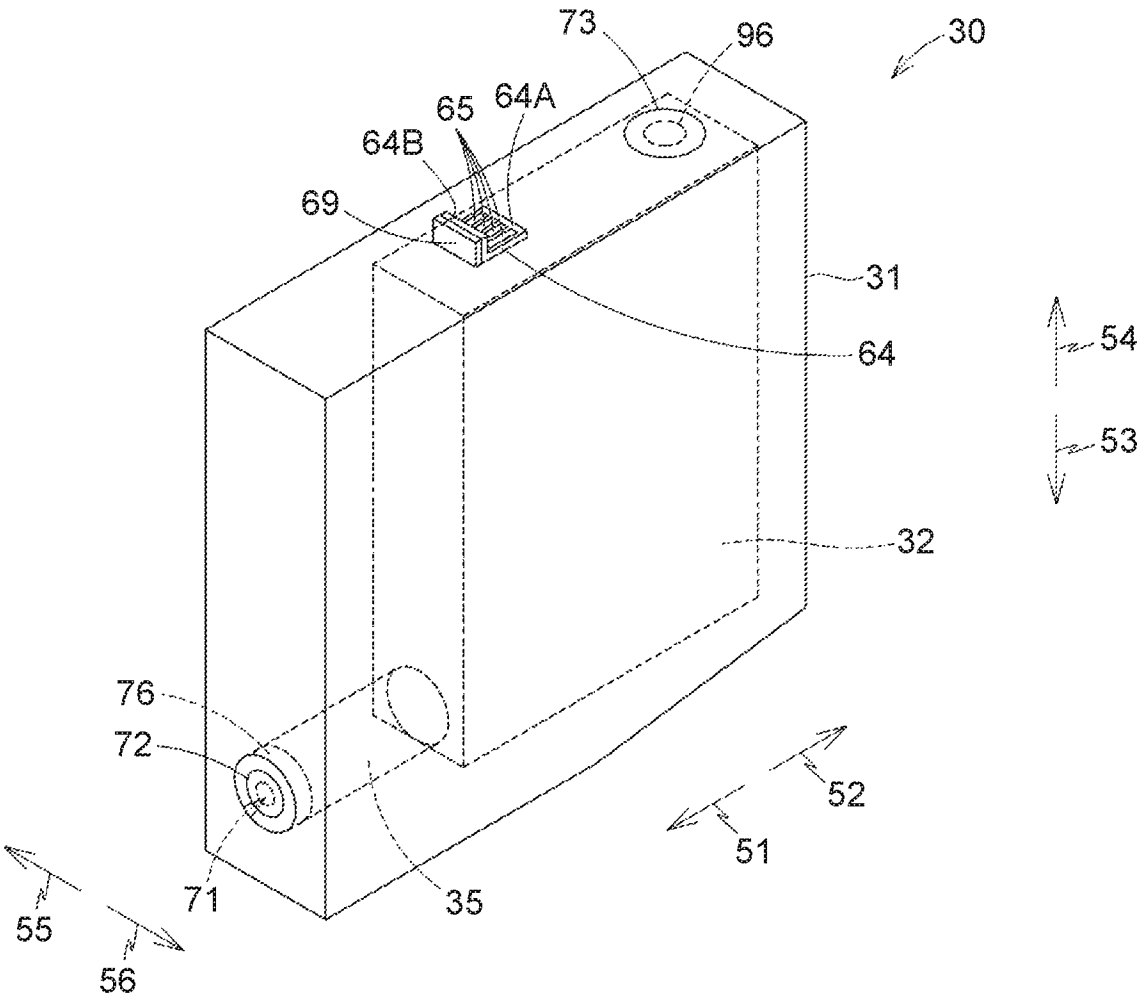
FIG. 18 is a perspective view of an ink cartridge in a modification according to one or more aspects of the disclosure, the ink cartridge shown in the upright orientation.

The ink cartridge 30 may have configurations other than those described above in the illustrative embodiment and the modifications, provided that the ink cartridge 30 is configured to pivot between the first posture and the second posture in the cartridge holder 101. For example, an ink cartridge 30 may be configured as depicted in FIG. 18. The ink cartridge 30 depicted in FIG. 18 includes a casing 31 having a generally rectangular parallelepiped outer shape. The casing 31 has an ink chamber 32 formed therein. The ink cartridge 30 depicted in FIG. 18 does not include the light blocking plate 67, the protruding portion 83, the protruding portion 43, or the operation portion 90. Similar to the illustrative embodiment, the IC board 64 includes the first surface 64A that is perpendicular to the up-down direction and faces upward, and the second surface 64B that is perpendicular to the front-rear direction and faces rearward. The ink cartridge 30 depicted in FIG. 18 includes a protrusion 69 that protrudes from an upper surface thereof in the upward direction 54 that is perpendicular to the front-rear direction. A portion of the IC board 64 is attached to the protrusion 69. As described in conjunction with the modification, the first surface 64A may not necessarily be perpendicular to the up-down direction, and the second surface 64B may not necessarily be perpendicular to the front-rear direction. In another modification, a recessed or stepped portion formed at the upper surface of an ink cartridge 30 may define the first surface 64A and the second surface 64B.

The ink cartridge 30 depicted in FIG. 18 does not include the coil springs 78 or 98. In other words, the ink cartridge 30 is not limited to such an ink cartridge configured to be inserted into the cartridge-receiver 110 against the biasing force acting in the rearward direction 52.

The ink cartridge 30 depicted in FIG. 18 does not include the valve 97. The ink cartridge 30 depicted in FIG. 18 may have an air communication port 96, for example, at an upper surface thereof. The air communication port 96 may be sealed by, for example, a removable label 73. The label 73 sealing the air communication port 96 may be removed before the ink cartridge 30 is attached to the cartridge-receiver 110.

The ink cartridge 30 depicted in FIG. 18 does not include the valve 77. The ink cartridge 30 depicted in FIG. 18 may include an ink supply portion 35 having a packing 76 at a front end portion thereof. The packing 76 has an ink supply port 71 formed at a central portion thereof. The ink supply port 71 is sealed by a removable label 72.

Figure 19:
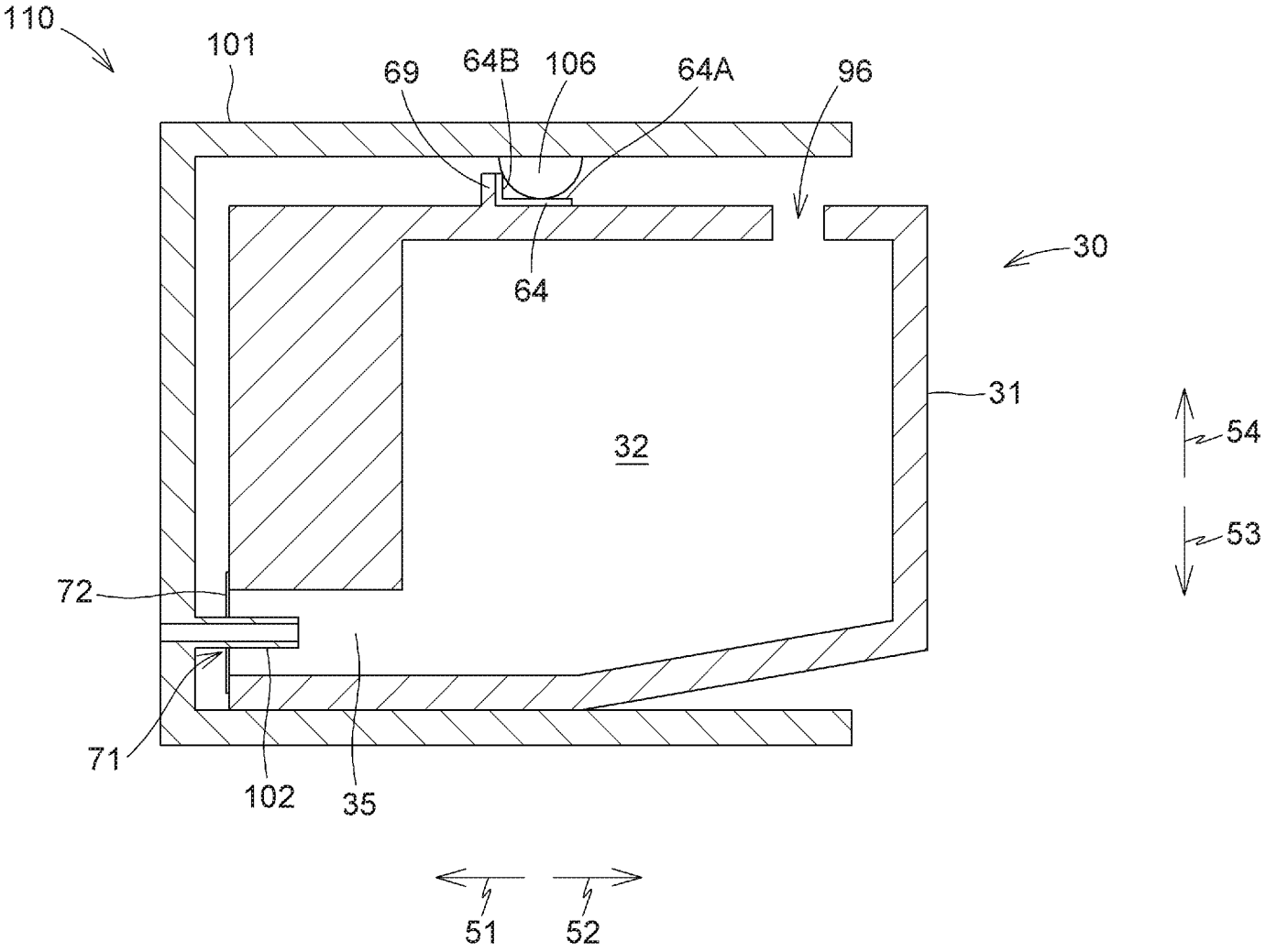
FIG. 19 is a vertical cross-sectional view of the ink cartridge of FIG. 18 attached to the cartridge-receiver in the first posture.

During the insertion of the ink cartridge 30 into the cartridge-receiver 110, the needle 102 located at the cartridge-receiver 110 pierces through the label 72 into the ink supply port 71 as depicted in FIG. 19, thereby allowing ink in an interior space 32 of the ink cartridge 30 to flow to the interior space 102A of the needle 102. The outer peripheral surface of the needle 102 fluid-tightly contacts an inner peripheral surface of the packing 76 defining the ink supply port 71 while elastically deforming the packing 76. This configuration may prevent or reduce ink leakage through a space between the needle 102 and the packing 76.

In a state in which the ink cartridge 30 has been attached to the cartridge-receiver 110 as depicted in FIG. 19, the electrical contacts 106 disposed at the cartridge-receiver 110 contact the first surface 64A and the second surface 64B.

In the illustrative embodiment, the electrical contacts 106 have elasticity. In another embodiment, the electrical contacts 106 may not necessarily have elasticity.

In the illustrative embodiment, ink serves as an example of liquid. However, the liquid of the disclosure is not limited to ink. For example, a liquid cartridge may store pretreatment liquid that is ejected onto a sheet prior to ink during printing. Alternatively, a liquid cartridge may store cleaning water for cleaning the recording head 21.

What is claimed is:

1. A liquid cartridge comprising:

a front wall;

a rear wall spaced apart from the front wall in a depth direction;

a top wall between the front wall and the rear wall;

a bottom wall spaced apart from the top wall in a height direction orthogonal to the depth direction;

a chamber disposed between the front wall and the rear wall in the depth direction and between the top wall and the bottom wall in the height direction and storing liquid;

a liquid outflow path extending in the depth direction and extending from the chamber to an outlet of the liquid outflow path and disposed closer to the bottom wall than the top wall in the height direction, the outlet being configured to communicate with an exterior of the liquid cartridge and facing frontward;

a circuit board disposed on the top wall and disposed rearward relative to the outlet in the depth direction;

a first surface facing at least upwardly in the height direction; and a second surface having an exposed surface facing at least rearwardly in the depth direction and crossing the first surface;

wherein;

a front end of the circuit board is disposed rearward relative to the liquid outflow path in the depth direction; and the circuit board includes at least one of the first surface and the second surface.

2. The liquid cartridge according to claim 1, wherein a rear end of the rear wall is disposed higher than the other of the rear wall in the height direction.

3. The liquid cartridge according to claim 2, wherein a rear end of the rear wall is disposed higher than a front end of the rear wall in the height direction.

4. The liquid cartridge according to claim 1, wherein the circuit board includes the second surface.

5. The liquid cartridge according to claim 1, wherein the circuit board includes the first surface.

6. The liquid cartridge according to claim 1, wherein the circuit board includes the first surface and the second surface.

7. The liquid cartridge according to claim 6, wherein the first surface is disposed rearward relative to the second surface in the depth direction and connected with the second surface.

8. The liquid cartridge according to claim 1, wherein the circuit board has flexibility and each of the first surface and the second surface includes an electrode.

9. The liquid cartridge according to claim 8, wherein the each of the first surface and the second surface includes four electrodes.

10. The liquid cartridge according to claim 1, further comprising a packing disposed in the liquid outflow path and having elasticity.

11. The liquid cartridge according to claim 10, further comprising:

a valve disposed in the liquid outflow path and contacting with the packing; and a spring disposed in the liquid outflow path and urging the valve toward the packing.

12. The liquid cartridge according to claim 1, wherein the first surface is flat.

13. The liquid cartridge according to claim 1, wherein the first surface is parallel with the top wall.

14. The liquid cartridge according to claim 1, wherein:

the first surface is inclined relative to the top wall; and a front portion of the first surface is disposed downward relative to a rear portion of the first surface in the depth direction.

15. The liquid cartridge according to claim 1, wherein:

the second surface is inclined relative to the top wall; and a front portion of the second surface is disposed upward relative to a rear portion of the second surface in the depth direction.

16. The liquid cartridge according to claim 1, wherein;

the front wall includes an upper front wall and a lower front wall below the upper wall; and the liquid outflow path is at the lower front wall.

17. The liquid cartridge according to claim 16, wherein:

the lower front wall is disposed rearward relative to the upper front wall in the depth direction; and the outlet of the liquid outflow path is disposed frontward relative to the lower front wall in the depth direction and disposed rearward relative to the upper front wall in the depth direction.

18. The liquid cartridge according to claim 1, wherein the second surface includes an electrode.

* * * * *